US010031476B2

(12) United States Patent
Minagawa et al.

(10) Patent No.: US 10,031,476 B2
(45) Date of Patent: Jul. 24, 2018

(54) IMAGE FORMING APPARATUS HAVING FIXING DEVICE AND BLOWER FOR THE FIXING DEVICE

(71) Applicant: CANON KABUSHIKI KAISHA, Tokyo (JP)

(72) Inventors: Taisuke Minagawa, Suntou-gun (JP); Satoru Izawa, Suntou-gun (JP); Takahiro Uchiyama, Mishima (JP); Jun Asami, Susono (JP); Toshiya Kaino, Suntou-gun (JP); Wataru Uchida, Yokohama (JP); Ken Murooka, Yokohama (JP); Yasuhiko Fuse, Mishima (JP); Masatoshi Yoshida, Susono (JP); Tomooku Koyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/215,101

(22) Filed: Jul. 20, 2016

(65) Prior Publication Data

US 2016/0327902 A1 Nov. 10, 2016

Related U.S. Application Data

(63) Continuation of application No. 14/221,164, filed on Mar. 20, 2014, now Pat. No. 9,429,886.

(30) Foreign Application Priority Data

Mar. 22, 2013 (JP) ..... 2013-060305
Mar. 22, 2013 (JP) ..... 2013-060306
Sep. 27, 2013 (JP) ..... 2013-201705

(51) Int. Cl.
*G03G 15/20* (2006.01)
*G03G 21/20* (2006.01)
*F04D 25/16* (2006.01)

(52) U.S. Cl.
CPC ..... *G03G 21/206* (2013.01); *G03G 15/2017* (2013.01); *G03G 15/2021* (2013.01);
(Continued)

(58) Field of Classification Search
CPC ..... G03G 15/2082; G03G 15/2021; G03G 15/2042; G03G 15/2017; G03G 21/206; G03G 2221/1645; F04D 25/166
See application file for complete search history.

(56) References Cited

U.S. PATENT DOCUMENTS 5,325,158 A * 6/1994 Guelfo ..... B41J 29/377 355/30
2007/0059023 A1* 3/2007 Koshida ..... G03G 15/6573 399/92

(Continued)

FOREIGN PATENT DOCUMENTS

JP H04-051179 A 2/1992
JP H10-048981 A 2/1998

(Continued)

*Primary Examiner* — David M Gray
*Assistant Examiner* — Laura Roth
(74) *Attorney, Agent, or Firm* — Canon U.S.A., Inc. IP Division

(57) ABSTRACT

An image forming apparatus that forms a toner image on a recording medium includes an image forming unit that forms an unfixed toner image on a recording medium; a fixing unit that heats the recording medium bearing the unfixed toner image and fixes the unfixed toner image onto the recording medium at a nip portion; a heating member and a pressurizing member that touches the heating member and forms the nip portion therebetween; a blower having a fan and duct, that blows air to a non-sheet-passing area of a small-size recording medium in the heating member; wherein the duct includes a second opening through which airflow from the fan is directed to the conveyance roller pair, and wherein the second opening of the duct is configured not (Continued)

to overlap with the non-sheet-passing area of the heating member in a longitudinal direction of the heating member.

9 Claims, 19 Drawing Sheets

(52) U.S. Cl.
CPC ..... *G03G 15/2042* (2013.01); *F04D 25/166* (2013.01); *G03G 2221/1645* (2013.01)

(56) References Cited

U.S. PATENT DOCUMENTS

| | | | | |
|---|---|---|---|---|
| 2007/0280721 | A1* | 12/2007 | Kanai ..... | G03G 15/6573 399/92 |
| 2009/0285614 | A1* | 11/2009 | Hamaya ..... | G03G 15/6573 399/401 |

FOREIGN PATENT DOCUMENTS

| | | | |
|---|---|---|---|
| JP | 2005-037859 | A | 2/2005 |
| JP | 2007-078984 | A | 3/2007 |
| JP | 2012-032428 | A | 2/2012 |
| JP | 2012-103690 | A | 5/2012 |
| JP | 6176960 | B2 | 8/2017 |

* cited by examiner

IMAGE FORMING APPARATUS HAVING FIXING DEVICE AND BLOWER FOR THE FIXING DEVICE

The present application is a continuation of U.S. patent application Ser. No. 14/221,164 filed on Mar. 20, 2014, which claims priority from Japanese Patent Application No. 2013-060305 filed Mar. 22, 2013, No. 2013-060306 filed Mar. 22, 2013 and No. 2013-201705 filed Sep. 27, 2013, which are hereby incorporated by reference herein in their entirety.

BACKGROUND OF THE INVENTION

Field of the Invention

The present invention relates to an image forming apparatus such as an electrophotographic copier, printer, and the like.

Description of the Related Art

The image forming apparatus forming a toner image on a recording medium has a fixing device to fix the toner image to the recording medium. A fixing device that has a first fixing member, and a second fixing member between which a nip portion fixed is formed, is used as this fixing device. A recording medium that bears a toner image is heated by the heat of the first fixing member at the nip portion, which fixes the toner image on the recording medium.

According to such a fixing device, when small size recording mediums are continuously passed, excessive temperature rise of a non-sheet-passing area through which a recording medium does not pass, i.e. a sheet non-passing area temperature rise, may occur. Conversely, Japanese Patent Laid-Open No. 2007-79040 discloses a fixing device that has a fan which is disposed near a film and blows toward the film, a shutter that is disposed between the fan and film moves according to the width of the recording medium, wherein the non-sheet-passing area of the film is cooled by the fan blowing.

However, as processing speeds continue to increase in accordance with productivity improvements, if the fixing temperature is increased accordingly, cooling the non-sheet-passing area of the fixing device with only the fan that blows toward the film, as disclosed in Japanese Patent Laid-Open No. 2007-79040 becomes difficult.

This is because when the fan size is increased and blows a greater volume of air toward the film, the air thereof may move around the shutter and cool the sheet-passing area, which may cause a fixing failure.

SUMMARY OF THE INVENTION

According to a first aspect of the present invention, an image forming apparatus that forms a toner image on a recording medium includes an image forming unit configured to form an unfixed toner image on a recording medium, and a fixing unit configured to heat the recording medium bearing the unfixed toner image and fix the unfixed toner image onto the recording medium at a nip portion. The fixing unit further includes a heating member and a pressurizing member that touches the heating member so as to form the nip portion therebetween. The image forming apparatus also includes a first blower configured to blow air to a non-sheet-passing area of a small-size recording medium in the heating member, and a second blower configured to blow air to a non-sheet-passing area of a small-size recording medium in the pressurizing member. Upon the temperature of the non-sheet-passing area of the heating member exceeding a threshold temperature, the first blower blows air without the second blower blowing, and subsequently, the second blower starts blowing air together with the first blower.

According to a second aspect of the present invention, an image forming apparatus that forms a toner image on a recording medium includes an image forming unit configured to form an unfixed toner image on a recording medium, and a fixing unit configured to heat the recording medium bearing the unfixed toner image and fix the unfixed toner image onto the recording medium at a nip portion. The fixing unit further includes a first fixing member, and a second fixing member that touches the first fixing member and forms the nip portion therebetween. The image forming apparatus also includes a first blower configured to blow air to the end portions of the first fixing member in a direction orthogonal to a recording medium conveyance direction, and a second blower configured to blow air, in the direction orthogonal to the recording medium conveyance direction, so as to blow air only on the end portions of the second fixing member or so as to blow air more to the end portions of the second fixing member than to the center portion thereof. Blowing control of the first blower and the second blower differ.

According to a third aspect of the present invention, an image forming apparatus that forms a toner image on a recording medium includes an image forming unit configured to form an unfixed toner image on a recording medium, and a fixing unit configured to heat the recording medium on which has been formed the unfixed toner image and fix the unfixed toner image to the recording medium at a nip portion. The fixing unit further includes a heating member, and a pressurizing member configured to touch the heating member and forms the nip portion therebetween. The image forming apparatus also includes a first blower configured to blow air to the non-sheet-passing area of the recording medium of the heating member. The blower further includes a fan, and a duct that has a first opening facing the non-sheet-passing area and that guides the air from the fan to the non-sheet-passing area via the first opening. The fixing unit further includes a conveyance roller pair configured to convey the recording member of which fixing processing has finished, to the downstream side of the nip portion in the conveyance direction of the recording medium. The duct has a second opening to discharge air around the conveyance roller pair to the outside of the fixing unit, by wind from the fan via the second opening.

Further features of the present invention will become apparent from the following description of exemplary embodiments with reference to the attached drawings.

DESCRIPTION OF THE EMBODIMENTS

First Embodiment

Image Forming Apparatus

Figure 10:
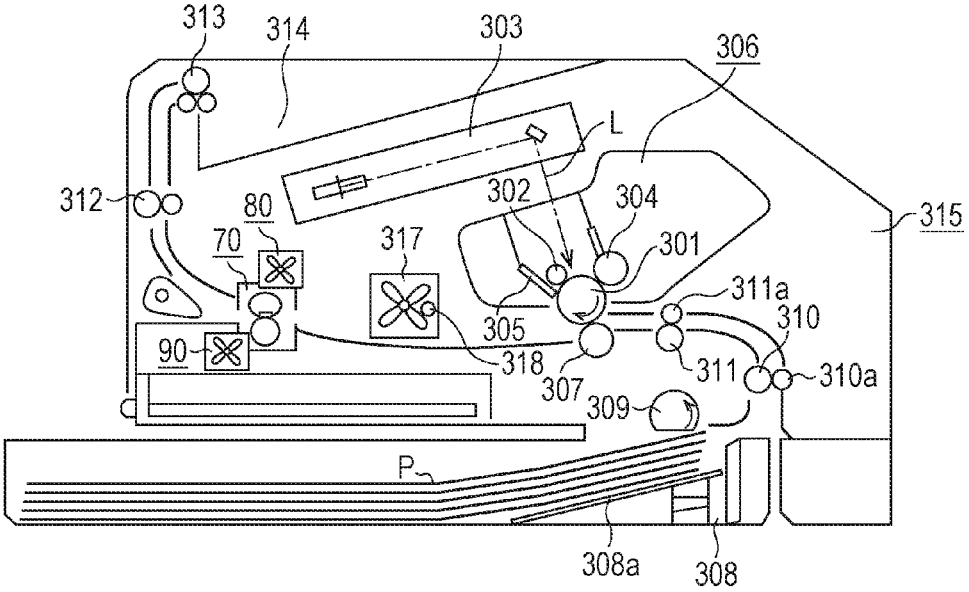
FIG. 10 is a schematic cross-sectional diagram of the image forming apparatus according to the first embodiment.

FIG. 10 is a schematic view of the image forming apparatus that can install the fixing device according to the present embodiment. The image forming apparatus herein is an electrophotographic laser printer, and forms an image according to image information input from an external host device such as a host computer on the recording medium.

Upon inputting a printing command from an external device, the image forming apparatus according to the present embodiment rotationally drives an electrophotographic photosensitive member in a drum form (hereinafter called photosensitive drum) 301 serving as an image bearing member at a predetermined speed (processing speed) in the arrow direction. The outer peripheral surface (the surface) of the photosensitive drum 301 is uniformly charged with a predetermined polarity and potential by a charger 302. Image information is written in as to the charged surface of the photosensitive drum 301 by a laser scanner 303 serving as an exposure device. The laser scanner 303 outputs a laser beam L that modulates according to the image information input into the printer from the external device. The laser scanner 303 subjects the charged surface of the photosensitive drum 301 to scanning exposure by the laser beam L. Thus, a static latent image is formed on the surface of the photosensitive drum 301 according to the image information. The static latent image is exposed as a toner image (developed image), using the toner (developing agent) by a developer 304. The toner image on the surface of the photosensitive drum 301 (hereinafter called toner image) is transported to a transfer nip portion that is between the photosensitive drum 301 surface and the outer peripheral surface (surface) of a transfer roller 307 that is disposed facing the photosensitive drum 301 surface, by the rotation of the photosensitive drum 301.

On the other hand, a recording medium P that is stacked on top of a sheet stacker 308*a* of a sheet supplying cassette 308 is picked up one sheet at a time by a supply roller 309 that is driving at a predetermined control timing, and transported to a registration unit by a conveyance roller 310 and a conveying rotatable member 310*a*. The tip of the recording medium P is temporarily stopped at the nip portion between a registration roller 311 and registration rotatable member 311*a* of the registration unit, skewing correction of the recording medium P is performed, and the recording medium P is transported to the transfer nip portion at a predetermined conveyance timing. That is to say, when the tip of the toner image on the surface of the photosensitive drum 301 reaches the transfer nip portion, the conveyance timing of the recording medium P is controlled so that the tip of the recording medium P will also reach the transfer nip portion.

The recording medium P transported to the transfer nip portion is subjected to pinch and convey by the photosensitive drum 301 and the transfer roller 307. In the conveyance process of the recording medium P, the toner image on the surface of the photosensitive drum 301 is transferred to the recording medium P by a transfer bias that is applied to the transfer roller 307, and the recording medium P is separated from the surface of the photosensitive drum 301 and conveyed to a fixing device 70. The description thus far is regarding the image forming unit.

The fixing device (fixing unit) 70 heats and fixes an unfixed toner image onto the recording medium P, by applying heat and pressure to the recording medium P bearing an unfixed toner image with a later-described nip portion (fixing nip portion) N, and discharges the recording medium P from the nip portion N.

The recording medium P discharged from the nip portion N of the fixing device 70 is conveyed by a first discharging roller 312 to a second discharging roller 313. The second discharging roller 313 then discharges the recording medium P onto a discharge tray 314.

The surface of the photosensitive drum 301 after the recording medium P is separated has residual toner removed therefrom by a cleaner 305, which is again supplied for image formation.

The image forming apparatus according to the present embodiment has a process cartridge 306 made up of the photosensitive drum 301, charger 302, developer 304, and cleaner 305 as an assembly. The cartridge 306 is removably attached as to an imaging forming apparatus 315 that makes up the housing of a printer.

An external air intake fan 317 is provided to the image forming apparatus main body 315. The external intake fan 317 is rotated as appropriate, and cools areas with increasing temperature such as the image forming unit, electrical substrate, and so forth, by taking in external air into the inside of the image forming device 315. An environmental sensor 318 is provided near the external air intake fan 317, and in the event that air from outside the device is taken in by the external air intake fan 317, the temperature and humidity of the environment in which the image forming apparatus 315 is disposed is detected. The detection results thereof are then fed back in a temperature control sequence of the fixing device 70.

A first blower 80 and a second blower 90 are disposed near the fixing device 70, and each of the first blower 80 and second blower 90 can independently blow. Note that the control of the first blower 80 and second blower 90 will be described later.

A movable regulation guide (unshown) to stack various types of recording mediums having different sizes is provided to the sheet stacker 308*a* of the sheet supply cassette 308. By displacing the regulation guide according to the size of the recording medium P and stacking the recording medium P on the sheet stacker 308*a*, different sizes of the recording medium can be picked up one sheet at a time from the sheet supply cassette 308 by the supply roller 309.

The imaging forming apparatus according to the present embodiment is an image forming apparatus supporting A4 size paper, and the print speed is 52 sheets per minute (A4 transverse feed).

Overview of Fixing Device

Figure 1:
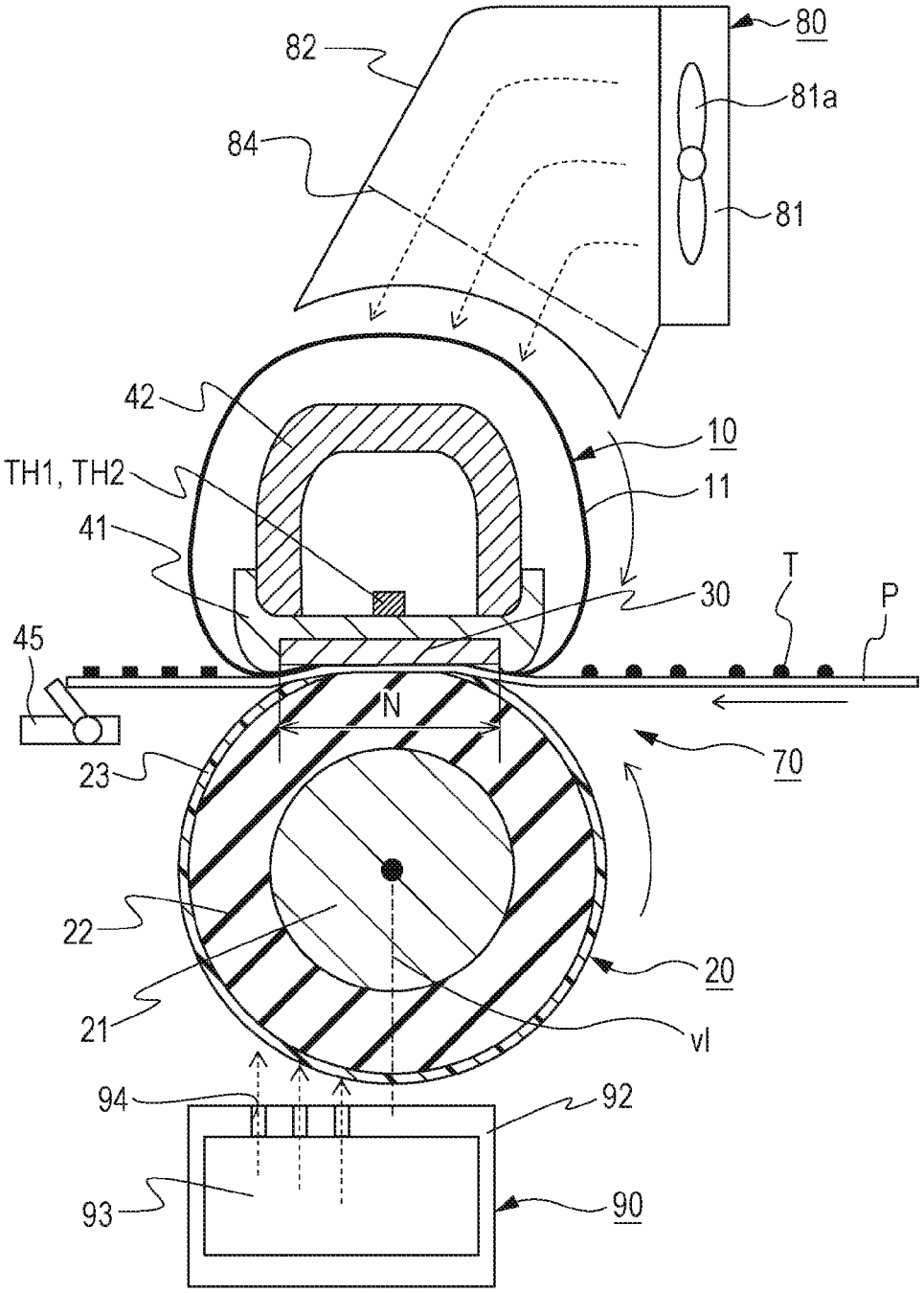
FIG. 1 is a cross-section view of a fixing device and blowing air according to a first embodiment.
Figure 2:
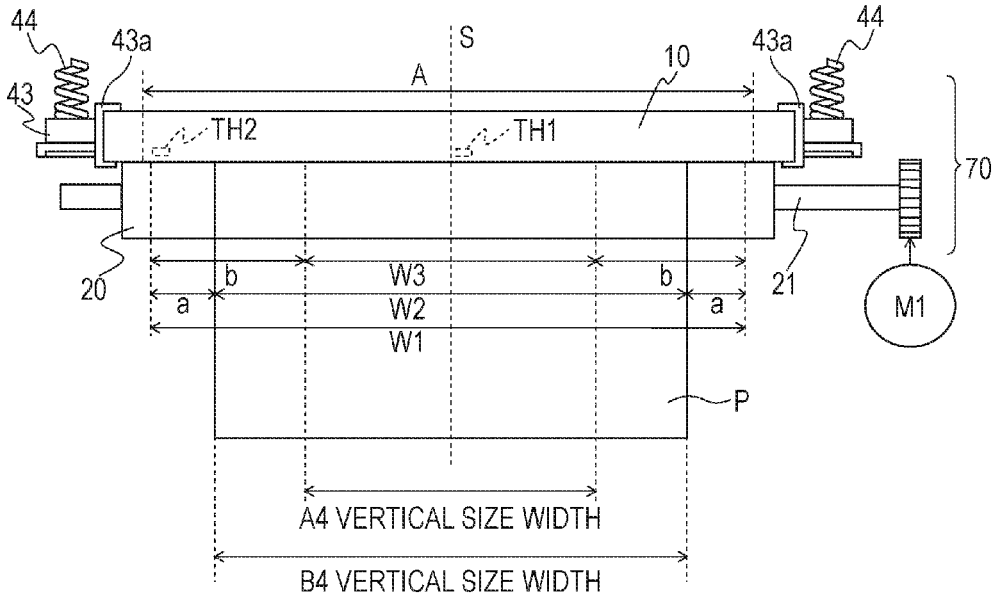
FIG. 2 is a front face view of a fixing device according to the first embodiment.
Figure 3:
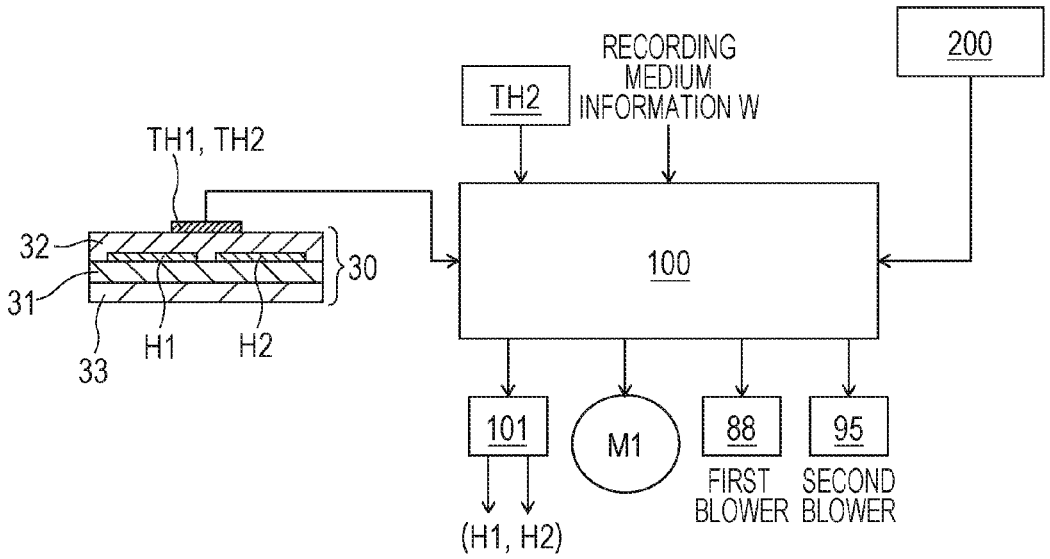
FIG. 3 is a cross-sectional diagram and control system diagram of a heater according to the first embodiment.

FIG. 1 is a cross-sectional view of the fixing device 70 and the first blower 80 and second blower 90. FIG. 2 is a front face view of the fixing device 70, and FIG. 3 is a cross-sectional view and control system view of a heater in the transverse direction. The fixing device and the blowers are installed on an unshown image forming apparatus such as an electrophotographic printer.

First, an overview of the fixing device 70 will be given with reference to FIGS. 1 and 2. The fixing device 70 has a cylindrical film 11 serving as a first fixing member, a heater 30 that touches the inner face of the film, and a pressurizing roller 20 serving as a second fixing member that forms a nip portion N between itself and the film 11. A film unit (heating member) 10 is an integrated unit of the film 11, heater 30, a guide member 41 that supports the heater 30, and a reinforcing stay 42 that reinforces the guide member. Flanges 43 in FIG. 2 are attached to the arm portions on the left and right ends of the reinforcing stay 42, and have a restriction portion 43*a* that restricts the film 11 from moving in the generatrix direction of the film.

The pressurizing roller 20 is an elastic roller having an elastic later 22 made from a silicon rubber or the like that is formed on the outer peripheral face of a metal core 21, and a surface layer 23 formed on the outside of the elastic later 22 and made up of a fluoroplastic such as PTFE, PFA, FEP, and the like. PTFE is polytetrafluoroethylene, PFA is a copolymer of tetrafluoroethylene and perfluoroalkyl vinyl ether, and FEP is a copolymer of tetrafluoroethylene and hexafluoropropylene.

The end portions of the metal core 21 of the pressurizing roller 20 are rotatably held between left and right side plates which is the frame (unshown) of the fixing device 70, via a bearing member. The heater 30 side of the film unit 10 is arrayed so as to face the pressuring roller 20, and a pressure spring 44 is provided as to the flanges 43 on the end portions of the reinforcement stay 42. Thus, the film unit 10 is urged towards the pressurizing roller 20 side.

The fixing device 70 described above heats a recording medium that bears a toner image at the nip portion N while conveying, and fixes the toner image to the recording medium.

Next, the configuration of the heater 30 will be described. FIG. 3 is a cross-sectional diagram and control system diagram of a heater 30. The heater 30 has a base 31, heat generation resistors H1 and H2 that are formed along the lengthwise direction of the base 31 on top of the base 31, a protective layer 32 formed on top of the heat generation resistors H1 and H2, and a sliding layer 33 that is formed on the face of the side touching the film 11. The base 31 is formed of a ceramic such as alumina or aluminum nitride or the like, and the protective layer 32 and sliding layer 33 are formed of glass or a fluoroplastic or the like.

By electrifying the heat generation resistors H1 and H2 of the heater 30 on the lengthwise end portions, the heat generation resistors H1 and H2 generate heat, and the heater 30 suddenly raises the temperature over the entire area of an active heating element area width A in the heater lengthwise direction. The temperature of the heater 30 is detected by a first thermistor TH1 serving as the first temperature detecting member disposed so as to touch the outer face of the protective layer 32, and the output thereof (signal values relating to temperature) is input into the control circuit 100 via an A/D converter. The control circuit 100, based on the input detection temperature information, controls the power from the power supply (power supply unit, heater driving circuit) 101 so as to maintain the temperature of the heater 30 as a target temperature (fixing temperature), as to the heat generation resistors H1 and H2, independently for each heat generation resistor.

The fixing device 70 is a fixing device of a type that drives a pressurizing roller 20 and rotates a film 11. Details will be described. As illustrated in FIG. 1, the pressurizing roller 20 is rotationally driven in the counter-clockwise direction of the arrow by a motor M1. Rotational driving force is applied to the film 11 by friction force at the nip portion, which is generated by rotational driving by the pressurizing roller 20. Thus, the film 11, of which the inner face rotates in the clockwise direction of the arrow while in close contact with the sliding layer 33 of the heater 30 at the nip portion, rotates at the same rotational speed as the pressurizing roller 20.

Rotation of the pressurizing roller 20 and warming up of the heater 30 is started, based on the printing signal input from the external host device 200. In a state wherein the rotation speed of the film 11 is the target speed, and the temperature of the heater 30 has reached the target temperature, the recording medium P that bears a toner image T at the nip portion N is fed so that the face bearing the toner image touches the film 11. The recording medium P moves together with the film 11 in a state of being sandwiched between the heater 30 and film 11 at the nip portion N. Heat is applied to the recording medium P by the film 11 that is heated by the heater 30 in the moving process thereof, and the toner image T is fixed to the recording medium P face. The recording medium P that has passed the nip portion is separated from the film 11 and conveyed so as to be discharged.

Note that a fixing device of a type wherein a heater touches the inner face of the film is exemplified and described according to the present embodiment, but the device is not to be limited to this. For example, a fixing device may be used which has a film, halogen heater contained inside a film, a nip portion forming member, and a pressurizing member that forms the nip portion via the film together with the nip portion forming member. This fixing device is a fixing device of a type that heats the inner face of the film by radiation heat from the halogen heater.

A non-sheet-passing area will be described with reference to FIG. 2. According to the present example, the conveyance of the recording medium P is performed with a so-called center standard conveyance, in which the center of the width direction of the recording medium is the conveyance standard. S is a virtual line indicating the conveyance standard of the recording medium thereof. W1 is a sheet passing width of the recording medium having the greatest width that can pass in a fixing device (hereinafter called maximum sheet-passing width). According to the present example, this maximum sheet-passing width W1 is an A3 size width of 297 mm (A3 longitudinal feed). In the direction that is orthogonal to the conveyance direction of the recording medium, the heat generating area width A in the lengthwise direction of the heater 30 is slightly larger than this maximum sheet-passing width W1, in order to secure fixability on both ends of the A3 size recording medium. W3 is a sheet-passing width of the recording medium having the smallest width that can pass in the fixing device (hereinafter called minimum sheet-passing width). According to the present example, this minimum sheet-passing width W3 is an A4 portrait size width of 210 mm (A4 longitudinal feed). W2 is a sheet-passing width of a recording medium having a width that is narrower than the maximum width recording medium and wider than the minimum width recording medium. According to the present example, the sheet-passing width W2 indicates a B4 size width of 257 mm (B4 longitudinal feed). Hereinafter, a recording medium having a width that corresponds to the maximum sheet-passing width W1 is called a maximum size recording medium, and a recording medium having a width that is smaller than the maximum size recording medium is called a small size recording medium. Here, "a" denotes a width difference portion between the maximum sheet-passing width W1 and the sheet-passing width W2 ((W1−W2)/2), and "b" denotes a width difference portion between the maximum sheet-passing width W1 and the minimum sheet-passing width W3 ((W1−W3)/2). That is to say, each is a non-sheet-passing portion when a B4 or A4 longitudinal feed recording medium, which is a small size recording medium, is passed. According to the present example, the conveyance of a recording medium uses the center standard, whereby the non-sheet-passing areas a and b occur on both side portions on the left and right of the sheet-passing width W2 and both side portions on the left and right of the minimum sheet-passing width W3, respectively. The width of the non-sheet-passing areas herein differ depending on the width of the small size recording medium used.

The thermistor TH1 serving as the first temperature detecting member is provided to the sheet-passing portion corresponding to the minimum sheet-passing width W3 of the heater 30, and detects the temperature of the heater 30. The thermistor TH2 serving as the second temperature detecting member detects the temperature of the heater 30 at non-sheet-passing portions other than the minimum sheet-passing width W3. The output of the thermistors TH1 and TH2 are input into the control circuit 100 via an A/D converter.

Note that the thermistors TH1 and TH2 may be provided to as to elastically touch the inner face of the film 11 that corresponds to the minimum sheet-passing-width W3 and the non-sheet-passing area a.

Configuration of First Blower

Figure 4A:
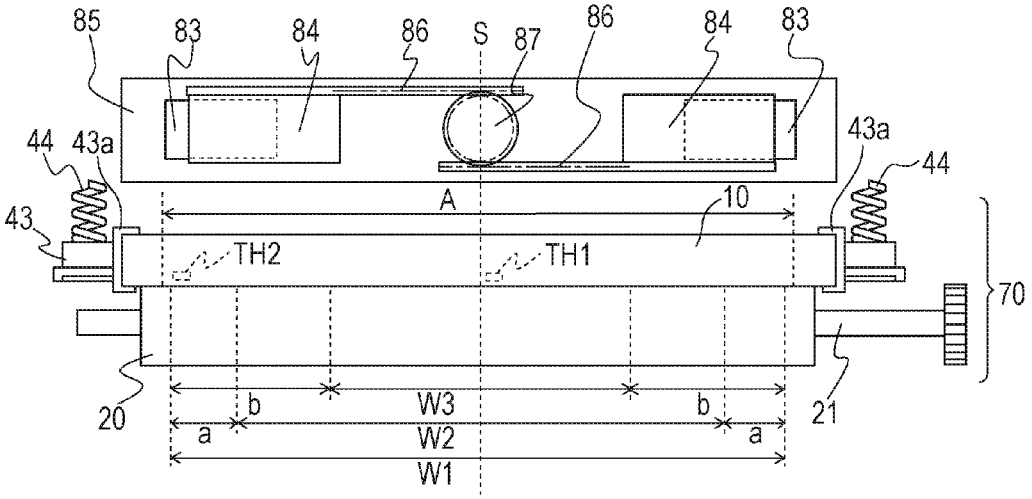
FIG. 4A is a diagram of the fixing device, as seen from the recording medium feeding side, according to the first embodiment.
Figure 4B:
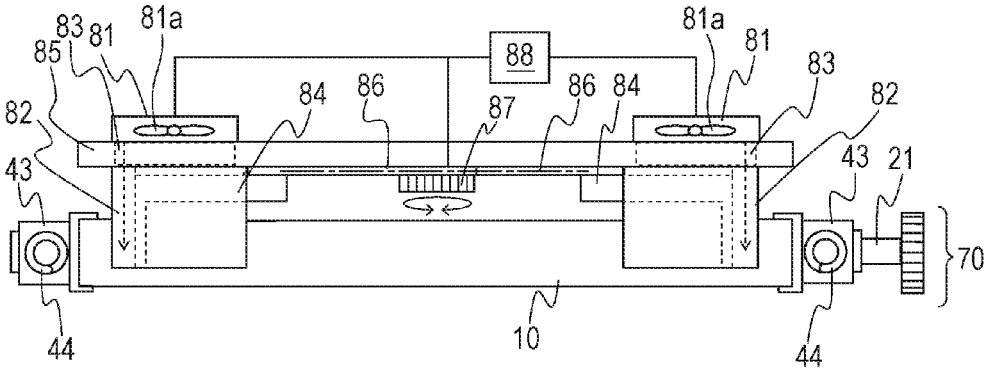
FIG. 4B is a diagram of a first blower, as seen from above, according to the first embodiment.

The first blower 80 is a part that blows air toward the film 11. The first blower 80 will be described with reference to a diagram of the fixing device in FIG. 4A as seen from the recording medium feeding side, and a diagram of a first blower 80 as seen from above in FIG. 4B.

The first blower 80 has a first fan 81, a duct 82 that guides the blowing air from the first fan 81 to the film unit 10, a shutter 84, and a shutter driving unit. The first fan 81 has a configuration wherein, upon power being supplied a motor (unshown) rotates and a first flywheel 81*a* rotates, whereby air is blown. The first fan 81 according to the first embodiment is an axial fan, but this may be a centrifugal fan.

Also, the first fan 81 is disposed so that the first flywheel 81*a* that blows air toward the film 11 is closer to the film 11 than the pressurizing roller 20. If the first flywheel 81*a* is disposed to be closer to the pressurizing roller 20 than to the film 11, the duct 82 becomes long, and pressure loss increases as the air reaches the film 11, whereby effectiveness is poor.

The duct 82 has an opening 83 that is disposed at a portion facing the film unit 10. Also, the shutter 84 is between the film 11 and the first fan 81, and is supported so that sliding movement is enabled along the supporting plate 85 extending in the direction orthogonal to the recording medium conveyance direction. This shutter 84 is connected by a rack gear 86 and a pinion gear 87, and the pinion gear 87 is driven by a motor (unshown) in the forward rotating direction or reverse rotating direction. Thus, the shutters 84 on the end portions are coupled and move as to the corresponding opening 83 thereof. The shutter is moved according to the size of the recording medium to be passed.

The first fan 81, duct 82, and shutter 84 are disposed on both ends symmetrically in the direction that is orthogonal to the recording medium direction of the film unit 10.

A shutter driving mechanism is made up of the support plate 85, rack gear 86, pinion gear 87, and motor (unshown) that drives the pinion gear. The width of the openings 83 on end portions in the recording medium conveyance direction is provided from the position slightly closer to the center than the non-sheet-passing area b when the minimum width recording medium is passed, toward the maximum sheet-passing width W1. The shutters 84 on the end portions are moved from the center in the direction that is orthogonal in the recording medium conveyance direction toward the end portions, and the openings 83 are closed by a predetermined amount, whereby the blowing area of the first fan 81 is set to be the width of the non-sheet-passing area of the film 11. The first fan 81 and shutter driving mechanism are operated by a control unit 88 that has received the signal of the control circuit 100.

The first fan 81 used in the present embodiment is a fan that can output air volume of 0.389 m^3/minute when the rotation speed is 100% at rated voltage. The rotation speed of the motor can be modified according to the film temperature increase speed. By modifying the motor rotation speed, the air volume that the first fan 81 blows to the non-sheet-passing area of the film 11 can be adjusted, whereby the non-sheet-passing portion temperature increase can be suppressed according to the temperature of the film 11 or the temperature increase speed. The control of the first fan 81 will be described later.

Configuration of Second Blower

Figure 5:
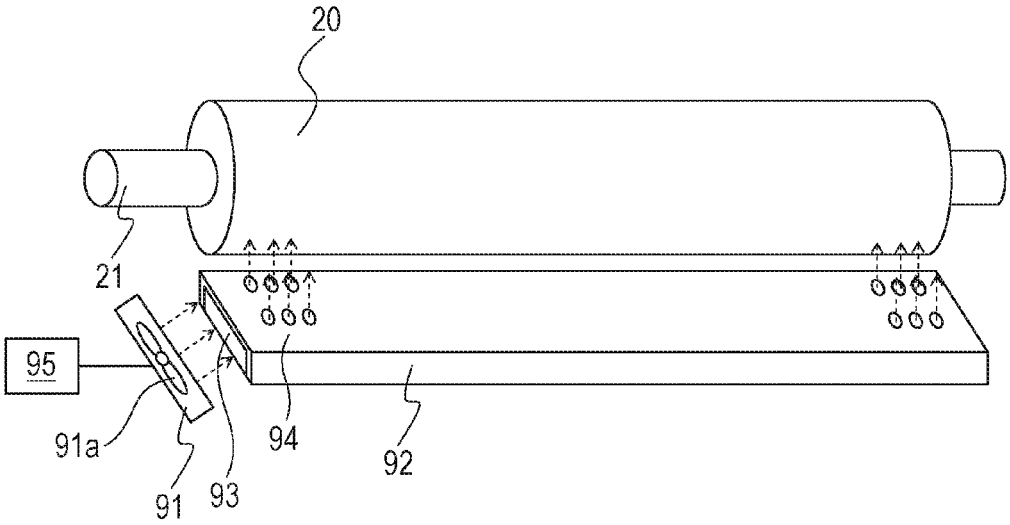
FIG. 5 is a perspective diagram illustrating a second blower and a pressurizing roller according to the first embodiment.

The second blower 90 is a part that blows toward the pressurizing roller 20. The configuration of the second blower 90 will be described with reference to a diagram illustrating the positional relation between the second blower 90 and the pressurizing roller 20 as illustrated in FIGS. 1 and 5. The second blower 90 has a second fan 91, and a duct 92 to guide the air generated by the second fan 91 to the pressurizing roller 20. The second fan 91 has a configuration such that, upon power being supplied, the motor rotates and the second flywheel 91*a* rotates, whereby air can be blown. The second fan 91 according to the first embodiment is an axial fan, but this may be a centrifugal fan.

Also, the second fan 91 is disposed so that the second flywheel 91*a* that blows air toward the pressurizing roller 20 is closer to the film 11 than the pressurizing roller 20. If the second flywheel 91*a* is disposed to be closer to the pressurizing roller 20 than to the film 11, the duct 92 becomes long, and pressure loss increases as the air reaches the pressurizing roller 20, so effectiveness is poor.

The duct 92 has a joining section 93 that couples the second fan 91 and the duct 92, and multiple vents 94. Upon an operating signal being transmitted from the control circuit 100 to the control unit 95, the second fan 91 rotates at a predetermined rotation speed. The air from the second fan 91 is guided toward the duct 92 via the joining section 93, and is blown from the vents 94 toward the pressurizing roller 20.

when the rotation speed of the motor at a rated voltage is 100%. By modifying the rotation speed of the motor, the air volume that is blown to the pressurizing roller 20 can be adjusted according to the temperature or temperature increase speed of the pressurizing roller 20. Control of the second fan 91 will be described later.

Control of Blowing Unit

Table 1 describes a control method of the first blower 80 and second blower 90 according to the present embodiment. The first blower 80 and second blower 90 according to the present embodiment controls the opening amount of the shutter 84 and the air volume of the first fan 81 and second fan 91 in accordance with the sheet size, environment, storage of heat of the fixing device, and temperature of the non-sheet-passing area. Information about the sheet size, environment, storage of heat of the fixing device, and temperature of the non-sheet-passing area are each obtained from a sheet width sensor, environment sensor, fixing count estimator, and the thermistor TH2. Note that of all of the operating targets in the second fan 91, the prevention of slipping due to condensation is described in the third embodiment. Also, the fixing count estimate will be described later in the present embodiment.

TABLE 1

| | | Condition to Start Operation of First Fan 81 and Second Fan 91 | | | |
|---|---|---|---|---|---|
| Operation target | Operation Purpose | Fixing Count | TH2 | Supply Power to First Fan 81 | Main Unit Installation Environment Humidity |
| First fan 81 | Suppress temperature increase in non-sheet-passing unit of film | — | Threshold temperature or greater | — | — |
| Second fan 91 | Suppress temperature increase in non-sheet-passing unit of pressurizing roller | — | — | Threshold power (60%) or greater | — |
| | Inhibit slipping due to condensation | Less than 1,001 | — | — | 80% or greater |

Now, according to the present embodiment, multiple vents 94 are provided only on the end portions of the duct 92 in the direction that is orthogonal to the recording medium conveyance direction, and the shape and number of vents are adjusted so that the air volume is even in the vents 94 on both end portions. The non-sheet-passing area when a letter-size recording medium is conveyed in transverse feed is the range in which the vents 94 are provided. Note that the configuration of the second blower 90 is not limited to the configuration according to the present embodiment, as long as the vents 94 are provided so that the air volume blown toward the pressurizing roller 20 is greater on the end portions rather than the center of the recording medium conveyance direction. For example, a configuration may be used wherein the number of vents 94 is greater on the end portions rather than the center in the direction orthogonal to the recording medium conveyance direction, or the size of the vents 94 is greater at the end portions than in the center in the direction orthogonal to the recording medium conveyance direction. Also, a shutter driving mechanism may be provided similar to the first blower 80, wherein a blowing range is changeable.

Figure 6A:
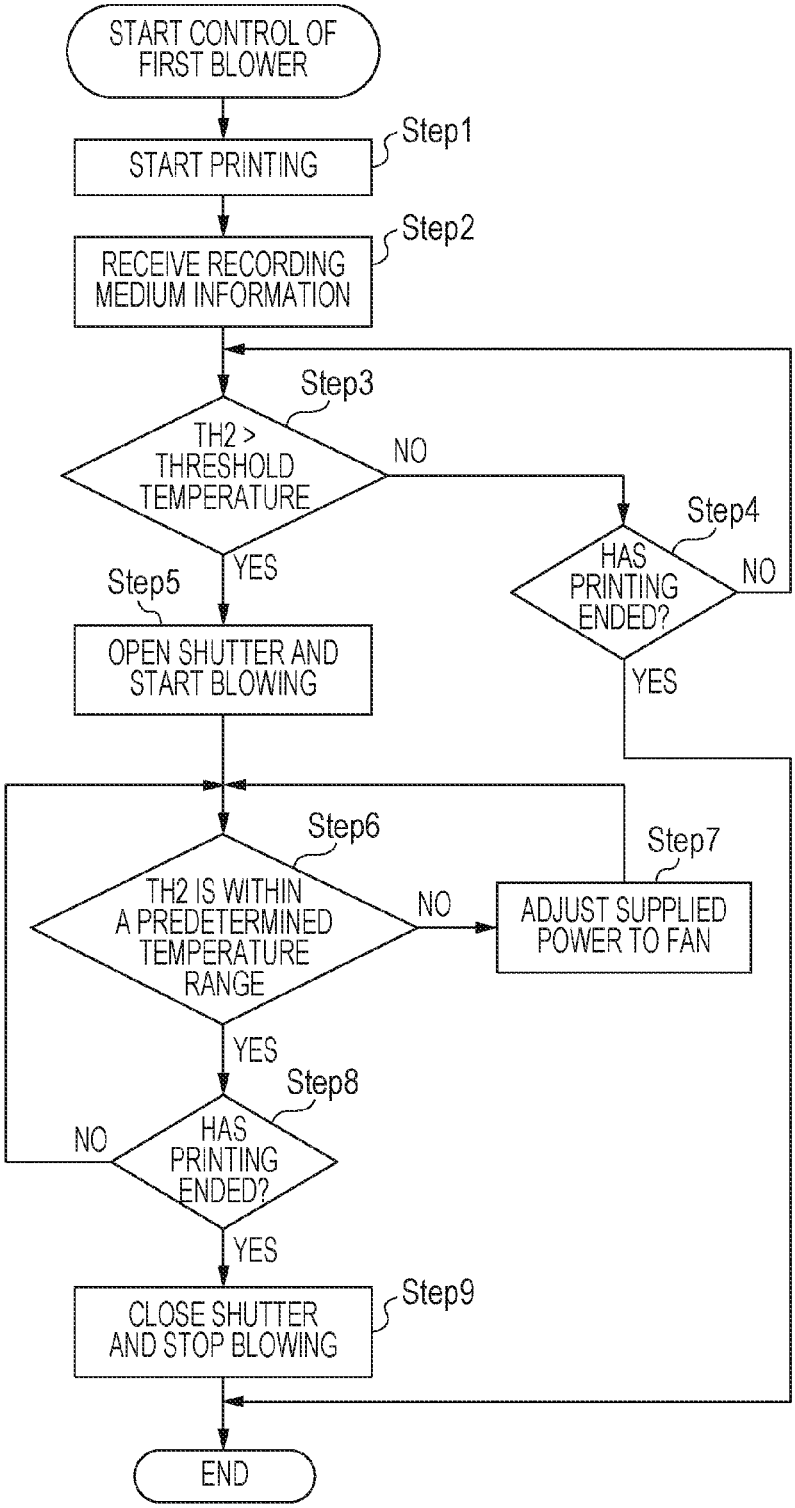
FIG. 6A is a flowchart illustrating control of the first blower according to the first embodiment.

The second fan 91 according to the present embodiment is a fan that can output an air volume of 0.14 m^3/minute Control of First Blower Control of the first blower 80 according to the present embodiment will be described with reference to the flowchart in FIG. 6A.

First, printing operations are started by printing signal input from an external host device 200 (Step 1). Subsequently, recording medium size information input by a user, and information relating to the recording medium width W that is passed from the information from a recording medium size detecting sensor such as a sheet-supply cassette or the like is obtained by the control circuit 100 (Step 2). Next, the control circuit 100 monitors the detection temperature of the thermistor TH2 during printing operations, and determines whether or not there is a temperature increase in the non-sheet-passing area of the film 11 (Step 3).

When the detection temperature of the thermistor TH2 reaches or exceeds a threshold temperature, the control circuit 100 performs operation instructions as to the control unit 88 to suppress the temperature increase in the non-sheet-passing area, based on the recording medium size information. Specifically, after the shutter is moved so that the opening 83 has the opening amount according to the recording medium size, power is supplied to the first fan 81, and blowing is started (Step 5). The supply power as to the first fan 81 is adjusted so that the detection temperature of the thermistor TH2 stays within a predetermined temperature range (Steps 6 and 7).

For example, when performing transverse feed of a letter-size sheet, the supply power as to the first fan 81 is adjusted so that the detection temperature of the thermistor TH2 which determines the start of the blowing is 250° C., the opening amount of the opening 83 is 5.3 mm, and the thermistor TH2 stays within a range of 250 to 260° C.

In the case that the printing processing has ended (Step 8), the power supply to the first fan 81 is stopped, and the shutter 84 is moved to a home position wherein the opening amount of the opening 83 is 0 mm (Step 9).

Note that in the case that the thermistor TH2 is monitored in Step 3 and the temperature remains lower than the threshold temperature until the end of the printing operation (Step 4), determination is made that significant non-sheet-passing portion temperature increase is not occurring, and so operations of the fan 81 are not performed.

Control of Second Blower

The second blower 90 according to the present embodiment has a function to assist the cooling of the non-sheet-passing area of the film 11 on the first blower 80 by cooling the non-sheet-passing area of the pressurizing roller 20. Specifically, after the first fan 81 blows without the second fan 91 blowing, the second fan 91 blows together with the first fan 81. According to the present embodiment, the first fan 81 performs control to increase the air volume as the detection temperature of the thermistor TH2 increases. However, the amount of blown air from the first fan 81 has an upper limit set, and when the air volume from the first fan has reached the upper limit, determination is made that the first fan alone does not suppress the non-sheet-passing portion temperature increase in the fixing device, and blowing of the second fan is started.

According to the present embodiment, the second fan 91 begins blowing when the power supplied to the first fan 81 has reached a predetermined amount of power. Control of the second fan 91 according to the present embodiment will be described in detail with reference to the flowchart in FIG. 6B. First, a printing operation is started by the printing signal input from the external host device 200 (Step 21). Next, the control circuit 100 monitors the supply power to the first fan 81 (Step 22), and in the case that the supply power thereof is greater than the threshold power, power is supplied to the second fan 91 via the control unit 95, and blowing is started (Step 24). That is to say, according to the present embodiment, driving and stopping the second fan 91 are performed according to the supply power to the first fan 81. In the configuration according to the present embodiment, the thermistor TH2 is disposed only in the non-sheet-passing area of the film 11, and the temperature increasing on the non-sheet-passing area of the pressurizing roller 20 is not directly detected. Therefore, in the case that the supply power to the first fan 81 is greater than the threshold power, and the amount of heat storage in the fixing device 70 is high, determination is made that the temperature increasing on non-sheet-passing area in the pressurizing roller 20 is also significant. According to the present embodiment, in the case that the supply power to the first fan 81 is 60% or greater, 100% of power is supplied to the second fan 91, and driving of the second fan 91 is started. 100% of power supply here refers to an air volume of 0.14 m^3/minute for the second fan 91, and in the amount that the temperature is sufficient to suppress the temperature increasing on non-sheet-passing area of the pressurizing roller 20 but not undershoot the temperature of the non-sheet-passing area. According to the present embodiment, the air volume of the second fan 91 is smaller than the air volume of the first fan 81. This is because the air volume of the second fan 91 that cools the pressurizing roller 20 which is indirectly heated can be smaller than the air volume of the first fan 81 that cools the film which is directly heated by the heater.

Supply power to the first fan 81 is monitored also during the printing operation (Step 25), and when the supply power is smaller than the threshold power, the power supply to the second fan 91 is ended, and the flow returns to Step 22. In the case that the printing operation is ended during driving of the second fan 91 (Step 27), the power supply to the second fan 91 is ended (Step 28).

In the case that the supply power to the first fan 81 is monitored in Step 22 and this supply power is smaller than the threshold power until the end of the printing operation (Step 23), determination is made that a significant the temperature increasing on non-sheet-passing area has not occurred, and the driving of the second fan 91 is stopped. By controlling the second fan 91 according to the supply power to the first fan 81, temperature increases of the non-sheet-passing area of the pressurizing roller 20 can be suppressed without providing a new temperature detecting member to the pressurizing roller 20. Note that a new temperature detecting member may be provided to the non-sheet-passing area of the pressurizing roller 20, thereby controlling the second fan 91 according to the detected temperature therefrom. This is because, of the members making up the fixing device 70, the pressurizing roller 20 has a large heat capacity, whereby the temperature of the pressurizing roller 20 and the amount of heat stored in the fixing device 70 are correlated.

Figure 6B:
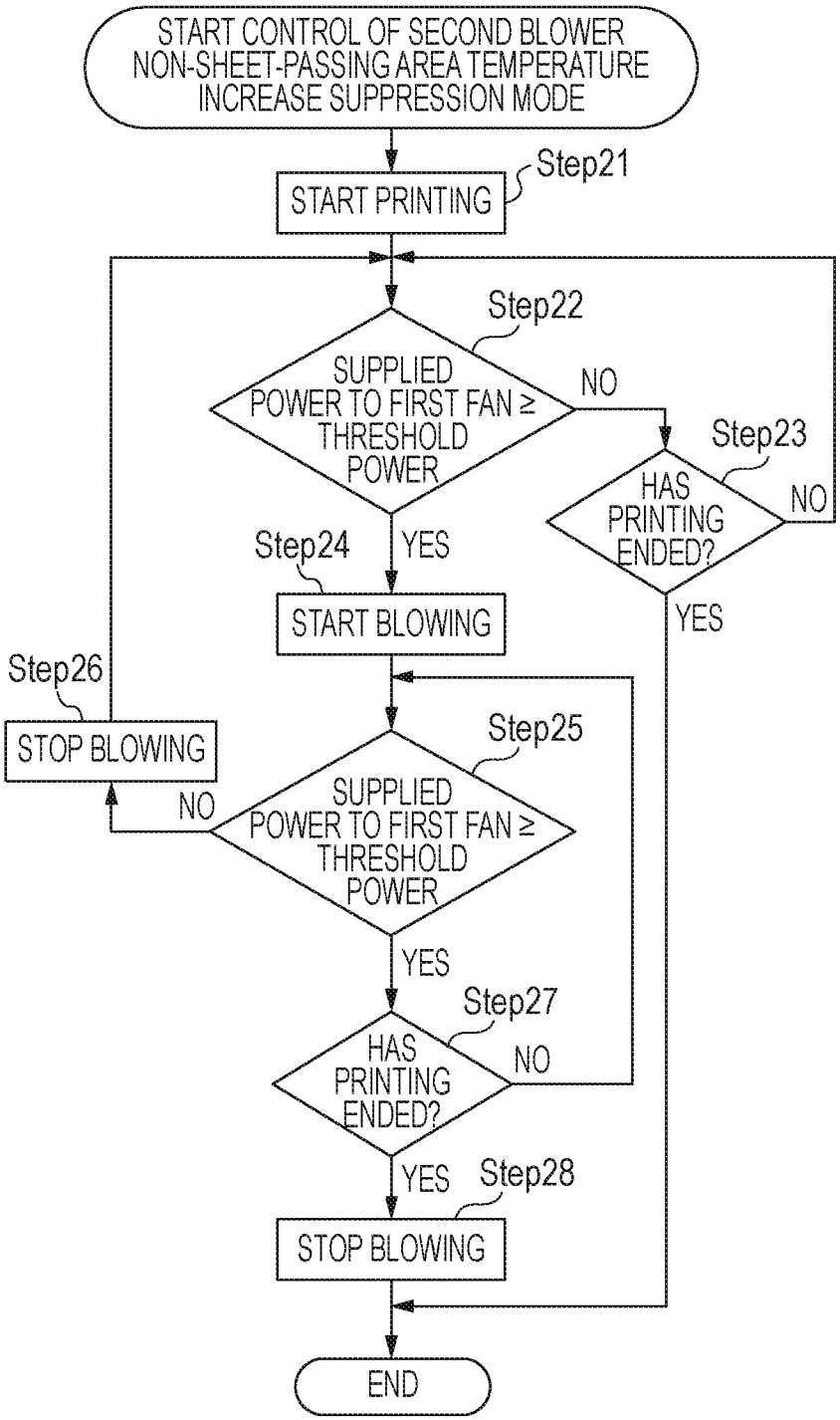
FIG. 6B is a flowchart illustrating control of the second blower when in a suppressing mode for temperature increasing on non-sheet-passing area, according to the first embodiment.
Figure 6C:
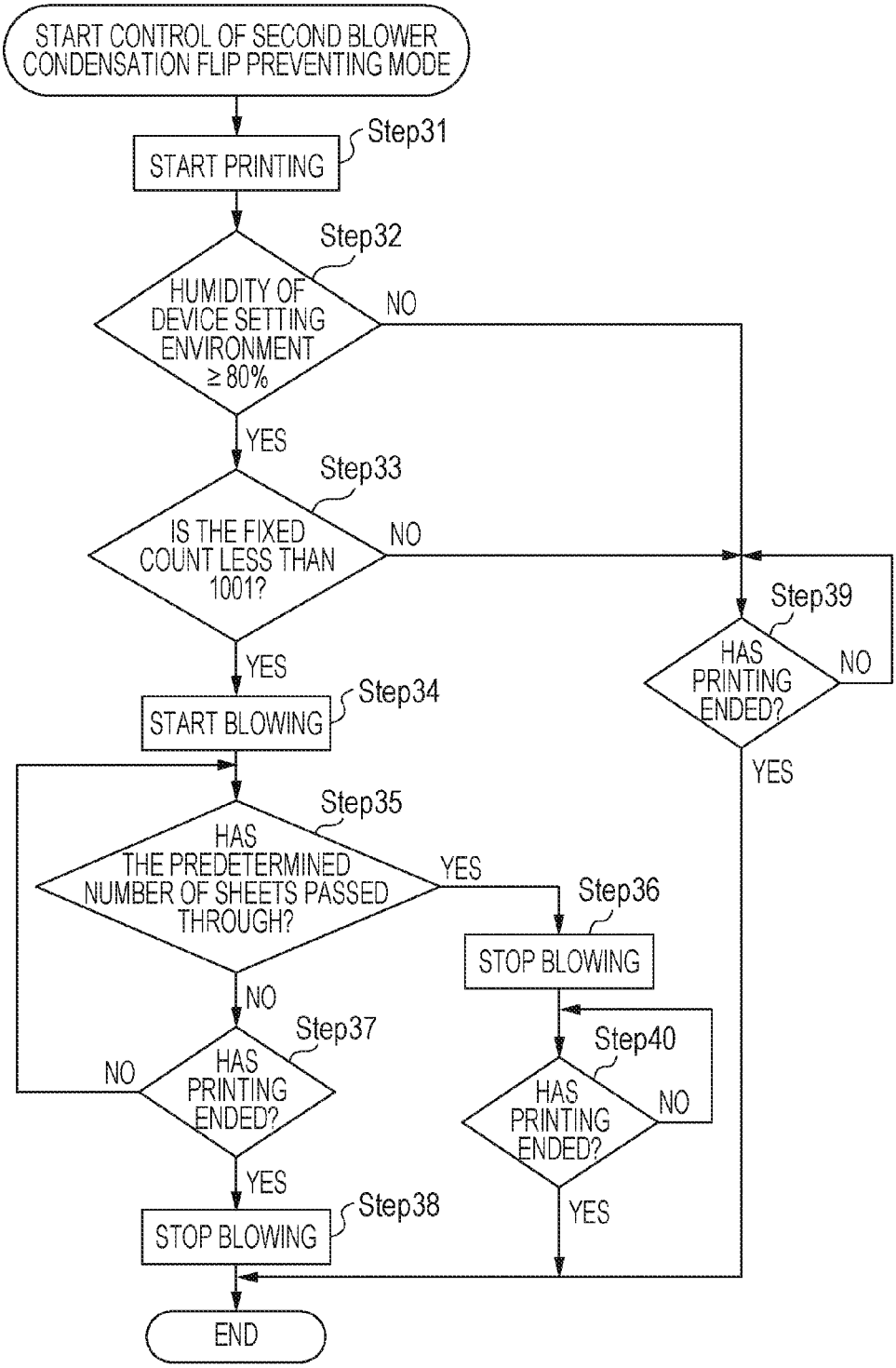
FIG. 6C is a flowchart illustrating control of the second blower when in condensation slipping prevention mode, according to a third embodiment.

Note that the condensation slipping prevention mode of the second blower in FIG. 6C will be described with a third embodiment.

In the case of a fixing device that has a film 11 which is directly heated by a heat source such as a heater or the like, and a pressurizing roller 20 that is not directly heated, as in the present embodiment, the first fan 81 that blows on the film 11 is better to be driven first rather than the second fan 91 that blows on the pressuring roller 20. This is because the temperature increase on the film 11 occurs faster than on the pressurizing roller 20.

Further, since the heat capacity of the film 11 is smaller than the heat capacity of the pressurizing roller 20 according to the present embodiment, the temperature increase on the film 11 occurs faster than on the pressurizing roller 20.

Fixing Count Estimation

Next, a fixing count estimation to estimate the temperature within the fixing device will be described. In the fixing count estimation according to the present embodiment, the printing operations are divided into multiple processes, where a predetermined coefficient is cumulated according to the heat influence on the pressurizing roller 20 for each of the processes, and the temperature of the pressurizing roller 20 is measured by the value of the cumulative count. These processes may be a preheating process from the time that the power supply to the heater 30 starts until a discharge sensor 45 turns on, a sheet-passing process that passes recording media at the nip portion, an interval period where the nip portion is between sheets and does not pass the recording medium, a device stopping period where there is no printing operations, and so forth. The coefficient for each process is calculated from the supply power to the heater, radiant heat amount, and so forth for each process. For example, the values may be like those defined in Table 2 below. The coefficient for each 200 msec is added in each process, and the temperature of the pressurizing roller 20 is estimated according to the cumulative count thereof. Note that when the power of the main unit is turned OFF, the cumulative count is reset. However, when the power is turned ON, the initial value of the cumulate count is determined based on the information of the thermistor TH1. Subsequently, as time passes, coefficients are added to this initial value. Also, in the case that information of the temperature and humidity of the environment in which the device is installed can be obtained from the environmental sensor 318, the added coefficients may be corrected based on this information. By correcting the coefficients by the information from the environmental sensor 318, the temperature of the recording medium and the radiant heat amount of the pressurizing roller, and input power according to the environmental information, can be considered, whereby estimation accuracy of the temperature of the pressurizing roller can be improved. Note that the temperature for which the fixing count estimation of the present embodiment is being made is the pressurizing roller temperature with the minimum sheet-passing width W3 which is not influenced by the non-sheet-passing portion temperature increases. The method to estimate the temperature in the fixing device is not limited to the above-described methods of determining from the number of printed sheets or detecting the pressuring roller temperature directly with a temperature detecting member.

Figure 7:
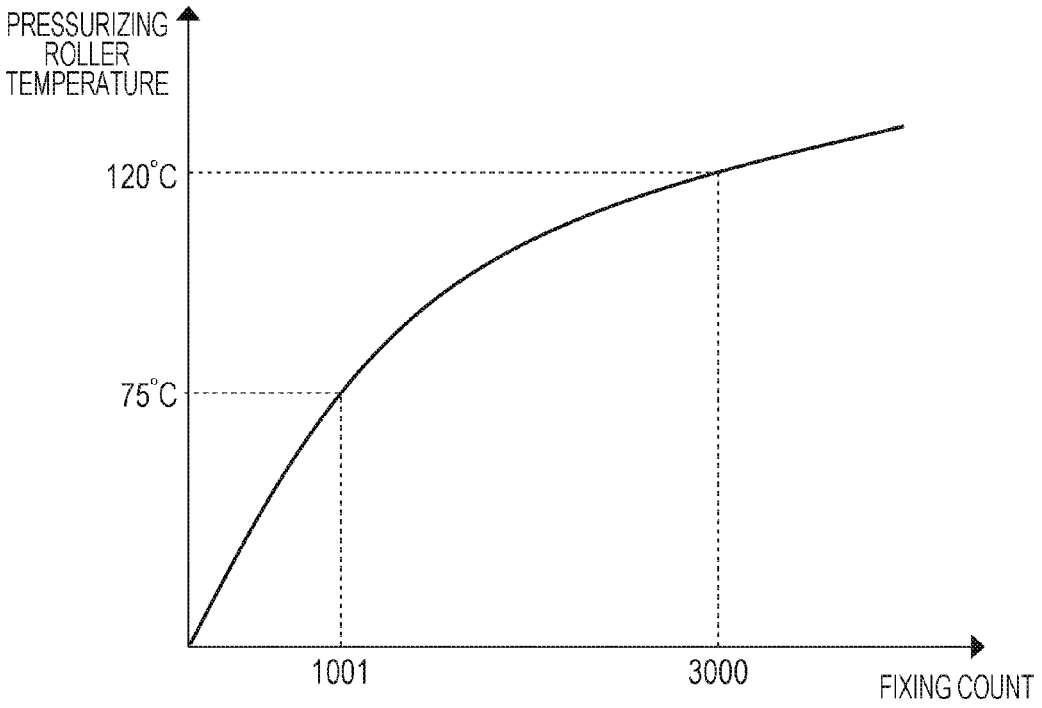
FIG. 7 is a diagram illustrating the relation between the fixing count and the pressurizing roller temperature.

FIG. 7 illustrates the relation between the cumulative count and pressurizing roller temperatures by the fixing count estimation. According to the present embodiment, in the case that the pressurizing roller temperature is lower than 75° C., determination is made that the fixing device is cooled. That is to say, when information that the cumulative count is less than 1001 is input into the control circuit 100 at the printing initialization in a high humidity environment, determination is made that the fixing device is in a cooled state (cold state).

TABLE 2

| | Cumulative count | | |
|---|---|---|---|
| Operation State | 0-1,000 | 1,001-3,000 | 3,001 |
| Preheating State | +7 | +5 | +3 |
| During sheet-passing | +5 | +3 | +1 |
| Between sheets | +3 | +2 | +1 |
| Main unit stopped | −5 | −10 | −20 |

Performance Evaluation

Figure 8A:
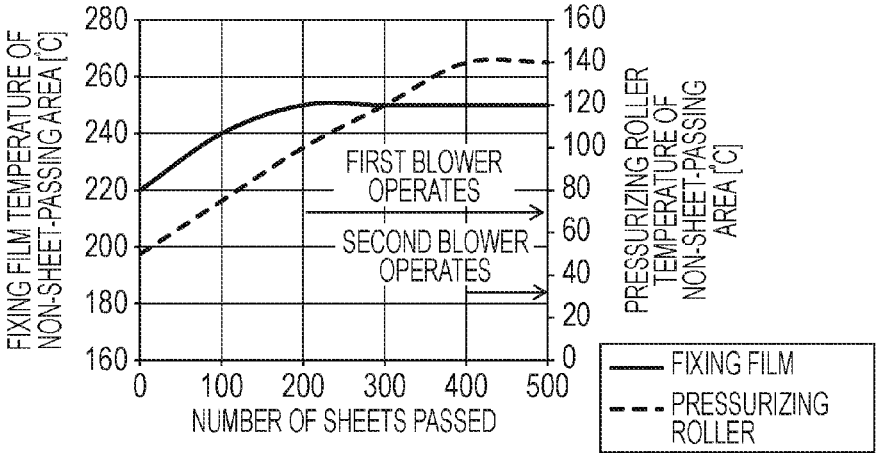
FIG. 8A is an explanatory diagram of temperature increasing on a non-sheet-passing area of the film and pressurizing roller, according to a second embodiment.

FIG. 8A illustrates the results of the present embodiment in the case of starting a printing operation while in a cold state in which the count from the fixed count estimation is less than 1001. The horizontal axis indicates the number of sheets passing, the left vertical axis indicates the temperature of the non-sheet-passing area of the film 11, and the right vertical axis indicates the temperature of the non-sheet-passing area of the pressurizing roller 20. The recording medium used was letter size paper with a basis weight of 90 g/m$^3$, which was continuously printed for 500 sheets in transverse feed. In FIG. 8A, the first fan 81 was driven at the timing when the printed sheets had reached 200 sheet from the start of continuous printing, and blowing toward the non-sheet-passing area of the film 11 was started. Further, the second fan 91 began driving at the timing when the printed sheets had reached 390 sheets from the start of continuous printing, and started blowing toward the non-sheet-passing area of the pressure roller 20. Thus, by controlling the driving start of the second fan 91 to be after the driving start of the first fan 81, the temperature increasing on non-sheet-passing area was suppressed without the film 11 and pressurizing roller 20 reaching the upper limit temperatures thereof. Further, the temperature increasing on the non-sheet-passing area of the pressurizing roller 20 did not excessively undershoot, and favorable fixability was obtained. This is because the blowing toward the non-sheet-passing area of the pressurizing roller was started after the pressurizing roller 20 had stored a certain amount of heat. The air volume of the second fan 91 being smaller than the first fan 81 also contributes to the pressurizing roller 20 not being excessively cooled. Note that the upper limit temperature of the film 11 according to the present embodiment is 270° C., which is when heat deterioration of the film 11 begins, and the upper limit temperature of the pressurizing roller 20 according to the present embodiment is 150° C., which is when heat deterioration of the pressurizing roller 20 begins.

Figure 8B:
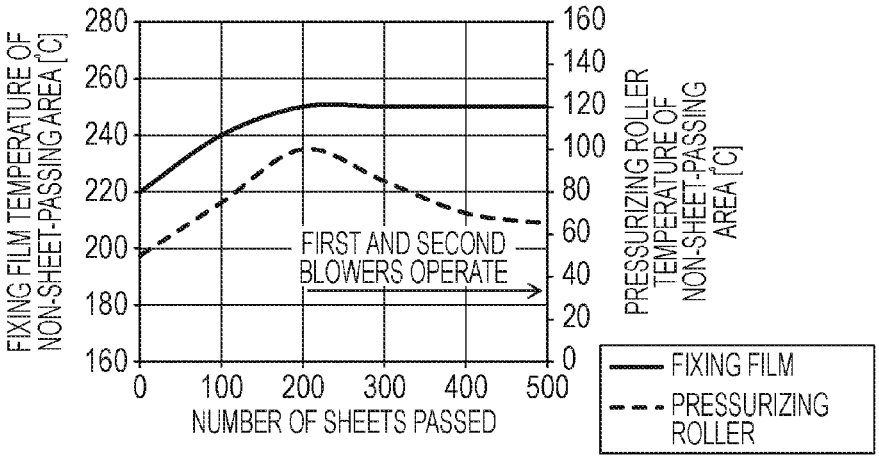
FIG. 8B is an explanatory diagram of temperature increasing on a non-sheet-passing area of the film and pressurizing roller, according to a first comparative example.

The operations of the first fan 81 illustrated in FIG. 8B as a first comparative example are similar to the present embodiment, and when the first fan 81 of the present embodiment started driving, the second fan 91 started driving at the same time. Note that the notation methods in the diagrams and other detection conditions are the same as FIG. 8B is the same as in FIG. 8A, so descriptions thereof will be omitted. The first fan 81 and the second fan 91 started driving at the time that the printing sheets had reached 200 sheets from the beginning of continuous printing, and the temperature increasing on the non-sheet-passing are of the film 11 was suppressed to under the upper limit temperature. However, the second fan 91 was driving from the time that the temperature of the pressurizing roller 20 was low and blowing of air toward the pressurizing roller 20 was started, whereby the temperature of the pressuring roller 20 excessively decreased, and a fixing failure occurred.

Figure 8C:
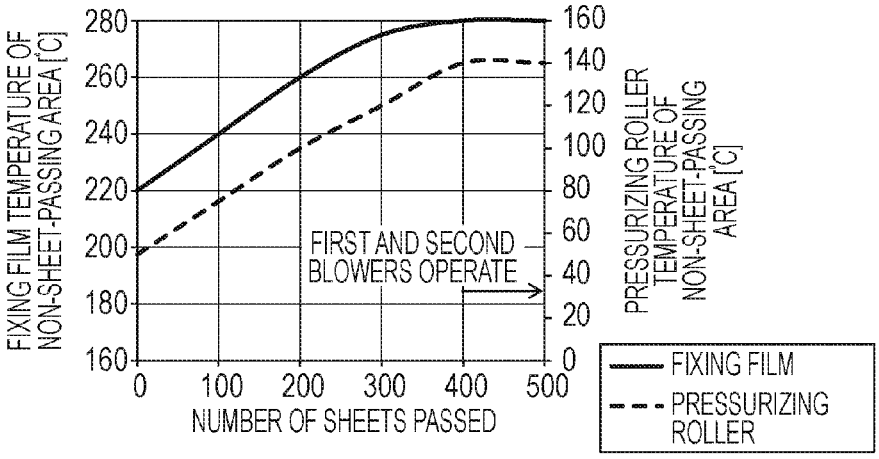
FIG. 8C is an explanatory diagram of temperature increasing on a non-sheet-passing area of the film and pressurizing roller, according to a second comparative example.

Results of a second comparative example, in the case of starting driving the second fan 91 and starting blowing toward the pressurizing roller 20 when the temperature of the non-sheet-passing area of the pressurizing roller 20 reaches 140° C., which is lower than the upper limit temperature, are illustrated in FIG. 8C. The driving start of the first fan 81 in the second comparative example is at the same time as the second fan 91. Note that the notation methods in the diagrams and other detection conditions are the same as FIG. 8B is the same as in FIG. 8A, so descriptions thereof will be omitted.

The first fan 81 and second fan 91 started driving at the point in time that the printed sheets reached the 390th sheet from the start of the continuous printing, and the temperature increasing on the non-sheet-passing area of the pressurizing roller 20 was able to be suppressed to below the upper limit temperature. On the other hand, the temperature increasing on the non-sheet-passing area of the film 11 exceeded the upper limit temperature of the film 11 at the point in time when the blowing by the first fan 81 was started.

Thus, the image forming apparatus according to the present embodiment has an advantage of being able to suppress temperature increases in the non-sheet-passing area of the film 11 without causing fixing failures resulting from blowing by the fans.

Note that according to the present embodiment, when the non-sheet-passing area of the film 11 has reached the threshold temperature, after the first blower (first fan 81) has blown without the second blower (second fan 91) blowing, the second fan 91 and first fan 81 blow. However, when the non-sheet-passing area of the film 11 has reached the threshold temperature, a light air may be blown by the second blower from the start.

Also, according to the present embodiment, the trigger for the second fan 91 to start blowing when the non-sheet-passing area of the film 11 has reached the threshold temperature is the power supplied to the first fan 81, but the temperature of the non-sheet-passing area of the film 11 (detecting temperature of the thermistor TH2) may also be used.

Also, according to the present embodiment, the first fan 81 and second fan 91 are provided to the image forming apparatus, but may be provided to the fixing device 70.

Second Embodiment

The present embodiment controls the first blower 80 and second blower 90 so as to suppress temperature increasing on the non-sheet-passing area for the next printing operation in the case that the temperature increasing on the non-sheet-passing area in the immediately preceding printing operation is significant.

The other configurations thereof are similar to the first embodiment, so the descriptions thereof will be omitted.

Control of First Blower

Figure 9A:
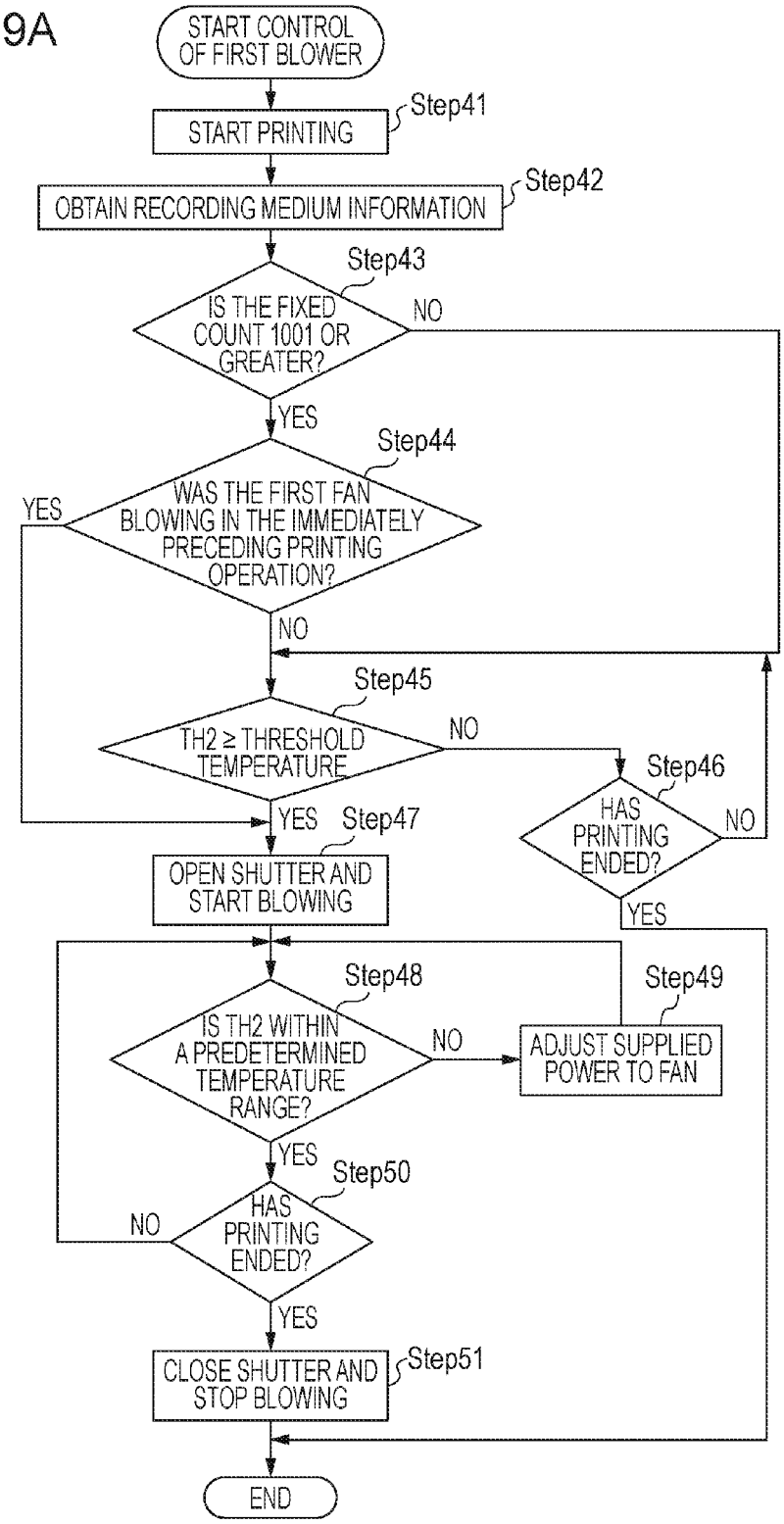
FIG. 9A is a flowchart illustrating control of the first blower according to the second embodiment.

Control of the first blower 80 according to the present embodiment will be described with reference to the flowchart in FIG. 9A.

According to the first embodiment, a first fan 81 of the first blower 80 is driven in the case that the thermistor TH2 which detects the temperature in the non-sheet-passing area of the film 11 is at or greater than a threshold temperature. However, in the case that the immediately preceding print job had ended in a state wherein temperature increase on the non-sheet-passing area had occurred, much heat may be stored in the non-sheet-passing areas of the film 11 and pressurizing roller 20, so the printing of the next print job may start with a disadvantageous state of the temperature increasing on the non-sheet-passing area.

According to the present example, the first fan 81 is controlled according to the stored heat in the fixing device immediately preceding the starting of printing. According to the present embodiment, a method to estimate the amount of heat stored in the fixing device with a fixing count is used. In the case that the amount of heat stored in the fixing device, and particularly the amount of heat stored in the pressurizing roller 20, is not fully comprehended from just the detecting temperature of the non-sheet-passing area of the film 11 from the thermistor TH2, the non-sheet-passing area of the film 11 may be able to be cooled quickly.

According to the first embodiment, a certain amount of idling time exists until the blowing of the first fan 81 actually starts, such as opening and closing the shutter mechanism or stationary waiting of a fan motor. This idling time is to prevent the film 11 from reaching a temperature at which heat degradation occurs.

According to the present embodiment, in the case that the fixing count is in a hot state of a count of 1001 or greater (Step 43), and the first fan 81 has been operating in the immediately preceding printing operation (Step 44), determination is made that there is a large amount of storage heat in the non-sheet-passing area of the fixing device. From the next printing start time, the driving of the first fan 81 is started (Step 47).

Note that the operations in Steps 41, 42, 45, 46, and Steps 48 through 51 are the same as in the first embodiment, so the descriptions thereof will be omitted.

Thus, even in a case wherein the temperature increasing on the non-sheet-passing area in the film 11 is significant from the immediately preceding printing, favorable non-sheet-passing area suppression effects similar to the first embodiment can be obtained.

Control of Second Blower

Figure 9B:
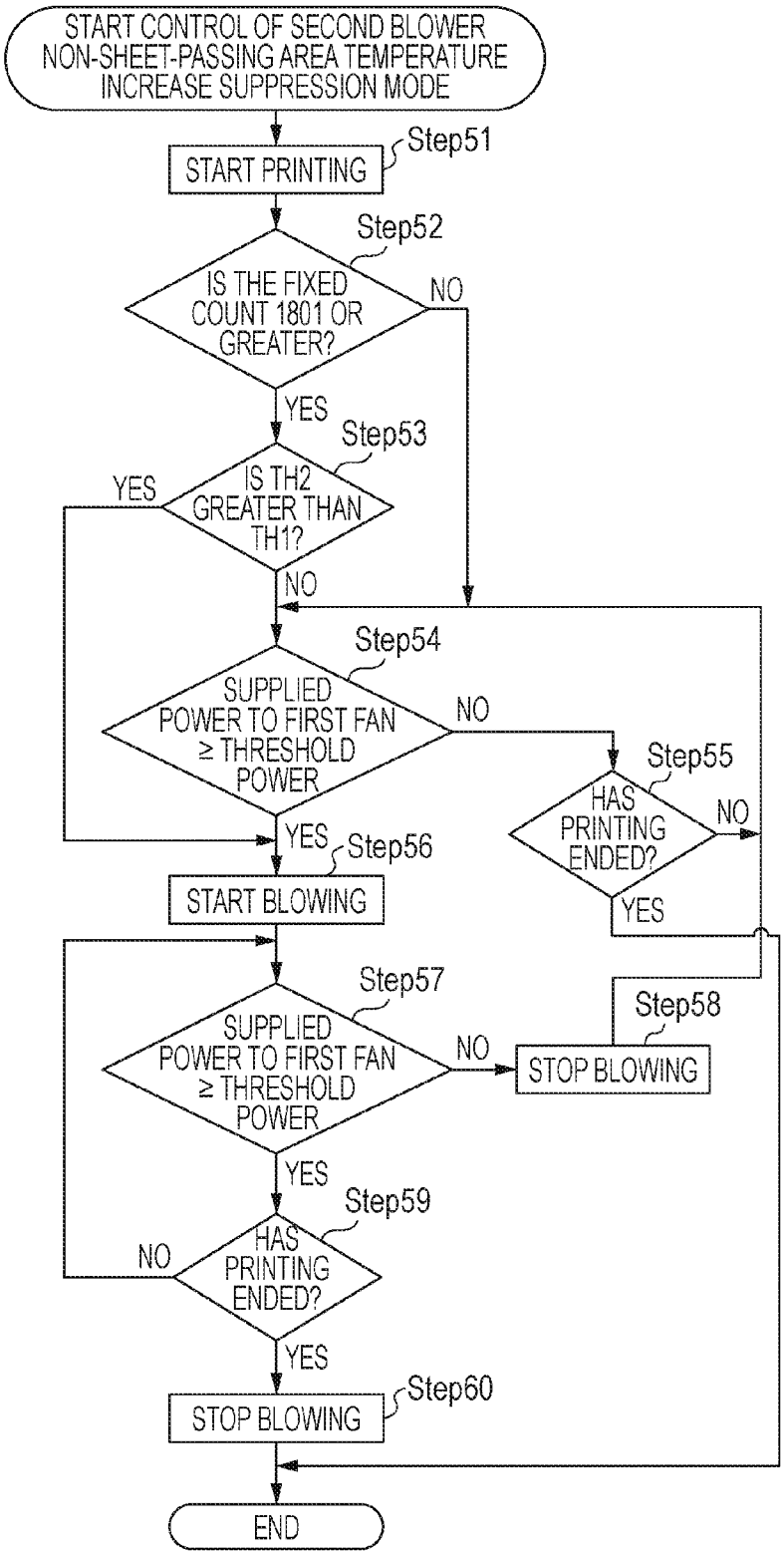
FIG. 9B is a flowchart illustrating control of the second blower when in a suppressing mode for temperature increasing on a non-sheet-passing area, according to the second embodiment.

Control of a non-sheet-passing area temperature increase suppression mode of the second blower 90 according to the present embodiment will be described with reference to the flowchart in FIG. 9B.

According to the present embodiment, in the case that the fixing count is in a hot state of a count of 1801 or greater (Step 53), and the detection temperature of the thermistor TH2 is higher than the detection temperature of the thermistor TH1 (Step 54), the driving of the second fan 91 is started (Step 57).

Note that the operations in Steps 52, 55, 56, and Steps 58 through 61 are the same as in the first embodiment, so the descriptions thereof will be omitted.

Thus, even in a case wherein the temperature increasing on the non-sheet-passing area in the pressurizing roller 20 is significant from the immediately preceding printing, favorable non-sheet-passing area suppression effects similar to the first embodiment can be obtained.

Note that a direct temperature detecting member may be provided to the pressurizing roller 20 and control the first fan 81 and second fan 91 according to the detection temperature.

Third Embodiment

The present embodiment differs from the first embodiment in that the second blower 90 is used to suppress slipping due to condensation. Note that the configuration of the image forming apparatus and fixing device according to the present embodiment are the same as the first embodiment, so descriptions thereof will be omitted.

First, slipping due to condensation will be described. In the case that the recording medium P is left unattended for a long period of time in a high-humidity environment, a large amount of moisture is held in the recording medium P. The moisture held in the recording medium P will instantly evaporate by the heat of the nip portion N and becomes steam, but the steam is more readily generated from the face of the recording medium P on which an image is not formed than the face of the side on which an image is formed. That is to say, steam is more readily generated from the face of the recording medium P on the side of the pressurizing roller 20 than from the face on the side of a fixing film 10. The reason for this is that on the face of the image forming face side of the recording medium P, the toner T on the recording medium inhibits the steam from escaping. Because of a current that is generated from the rotation of the pressurizing roller 20, the escaped steam on the side of the pressurizing roller 20 spreads so as to turn in from the downstream side to the upstream side in the rotation direction of the pressurizing roller 20 of the nip portion N. In the case that the pressurizing roller 20 is not warmed up, the steam near the pressurizing roller 20 condenses on the surface of the pressurizing roller 20, whereby slipping readily occurs between the pressurizing roller 20 and the fixing film 10. If slipping occurs between the pressurizing roller 20 and the fixing film 10, there may be cases where the fixing film 10 does not rotate following the same rotation speed as the pressurizing roller 20. Consequently, the conveyance speed of the recording medium P at the nip portion N greatly decreases as compared to the conveyance speed at the transfer unit, whereby the recording medium P warps and is pushed into the transfer unit, or the recording medium P is rubbed while in the conveyance path and the toner image can splatter, causing a defective image. The phenomenon wherein condensation forms on the pressurizing roller 20, whereby the rotation speed of the fixing film 10 is decreased or stopped, leading to an image defect, is called "slipping due to condensation".

Now, based on reviews by the present inventors, determination has been made that when condensation forms in the non-sheet-passing area of the pressurizing roller 20, slipping between the pressurizing roller 20 and the fixing film 10 occurs readily, and slipping due to condensation occurs more than does condensation in the sheet passing area. The reason for this is that the non-sheet-passing area of the pressurizing roller 20 is the portion where the pressurizing roller 20 directly touches the fixing film 10 while the sheet is passing the nip portion N, and the contribution ratio to apply driving force to rotate the fixing film 10 is greater than the sheet-passing area. Further, slipping due to condensation occurs more readily when the sheet is wider. In the case of passing a sheet having a narrow width, the area for steam to be generated is narrower, and the non-sheet-passing area for the pressurizing roller 20 to cause the fixing film 10 to follow and rotate is wide. Therefore, condensation does not form on the entire area of the non-sheet-passing area of the pressurizing roller 20, and at the speed below the rotation speed of the fixing film 10 or when stopped, condensation does not readily form. On the other hand, in the case of passing sheets having a wide width, the area in which steam is generated is wider, so the amount of steam increases, and the non-sheet-passing areas for the pressurizing roller 20 to cause the fixing film 10 to rotate and follow is narrow. Accordingly, slipping due to condensation may occur on the pressurizing roller 20, since condensation can form in the axis direction, not only in the sheet-passing area but also in the non-sheet-passing area, and speed decreases and stopping of the fixing film 10 readily occurs. Further, slipping due to condensation readily occurs when the difference between the ease in warming up of the first fixing member on the side that touches the unfixed toner image and the second fixing member on the side that does not touch the unfixed toner image is great. This is because warming up of the fixing device is often considered to be complete when the temperature of the first fixing member has reached a fixable temperature, and the temperature of the second fixing member is not managed. In particular, in a configuration as in the present embodiment, wherein a thin fixing film 10 is directly heated by the heater 30, and the pressurizing roller 20 which has a thick rubber layer is not directly heated by the heater, the pressurizing roller 20 readily forms condensation.

Therefore, according to the present embodiment, during conditions when condensation is more likely to form, the second blower 90 illustrated in FIG. 5 blows only on the non-sheet-passing area of the pressurizing roller 20. The vents 94 are only provided on the end portions of the duct 92 in the direction that is orthogonal to the recording medium conveyance direction, so the surface of the pressurizing roller 20 is not excessively cooled, and slipping due to condensation can be suppressed.

Next, the operations of the second blower (second fan 91) in condensation slipping prevention mode according to the present embodiment will be described with reference to the flowchart in FIG. 6C. Note that according to the present example, the non-sheet-passing area temperature increase suppression mode of the first blower as illustrated in FIG. 6A and the non-sheet-passing area temperature increase suppression mode of the second blower as illustrated in FIG. 6B may be executed.

According to the present embodiment, upon the printing operation having started (Step 31), the humidity in the environment in which the device is installed is detected by the environmental sensor 318, and in the case that the detection humidity is 80% or greater (Step 32), determination is made that the recording medium P may hold a large amount of moisture. Also, in the case that the temperature of the pressurizing roller 20 is estimated to be less than 75° C. by the fixing count estimated described in the first embodiment, determination is made that slipping due to condensation slipping. In the case that the device installation environment has humidity of 80% or greater and the count by the fixing count estimate is less than 1001 when starting the printing (Step 33), power supply to the second fan 91 is started via the control unit 95, and the blowing toward the pressurizing roller 20 is started (Step 34). Thus, the steam generated from the recording medium P near the pressurizing roller can be discharged. Note that the supplied power to the second fan 91 which in condensation slipping mode is sufficient to discharge the steam near the pressurizing roller 20, and is 50%, which is enough to not excessively cool the pressurizing roller. In the case that printing of 30 sheets or more, with a letter-size transverse feed in which the temperature in the non-sheet-passing area of the pressurizing roller 20 readily increases is ended (Step 35), the power supply to the second fan 91 is ended, and the driving of the second fan 91 is stopped (Step 36). Also, in the case that the printing operation is ended before 30 sheets are printed (Step 37), the power supply to the second fan 91 is also ended, and the driving of the second fan 91 is stopped (Step 38).

Thus, the image forming apparatus of the present embodiment can suppress slipping due to condensation without greatly reducing the surface temperature of the pressurizing roller.

Fourth Embodiment

The configuration of the second blower 90 according to the present embodiment is illustrated in FIG. 11. The present embodiment is similar to the third embodiment, except that the configuration of the duct 99 differs from the third embodiment. Accordingly, descriptions of the image processing apparatus and fixing device other than the duct 99 will be omitted.

The duct 99 is an opening provided on the end portions in the direction that is orthogonal to the recording medium conveyance direction, and has an opening 93 to take in the air from the second fan 91, and multiple holes 94 to discharge the air taken in from the opening 93 toward the pressurizing roller 20. Accordingly, after the air from the second fan 91 is taken in to the inner portion of the duct from the opening 93, the air flows along the axis direction of the pressurizing roller 20. Since the end portion 95 on the opposite side of the opening 93 of the duct 99 is closed, the air thereof blows out from the multiple holes 94 provided to an area a on the face of the duct 99 that faces the pressurizing roller 20, toward the surface of the pressurizing roller 20.

Next, the locations to provide the holes 94 on the duct 99 will be described. On the face of the duct 99 that faces the pressurizing roller 20 (hereinafter called facing face), the area facing the recording medium passing area will be represented by α, and the area facing the non-passing area will be represented by β. The steam generated from the recording medium having passed the nip portion N comes around from the downstream side of the rotation direction of the film 10 of the nip portion N to the rotation direction of the pressurizing roller 20. Therefore, as illustrated in FIG. 1, if the holes 94 are provided near a perpendicular line v1 drawn from the axis center of the pressurizing roller 20 down to the facing face, or on the downstream side in the recording medium conveyance direction from the perpendicular line v1, the steam can be effectively dissipated.

Figure 11A:
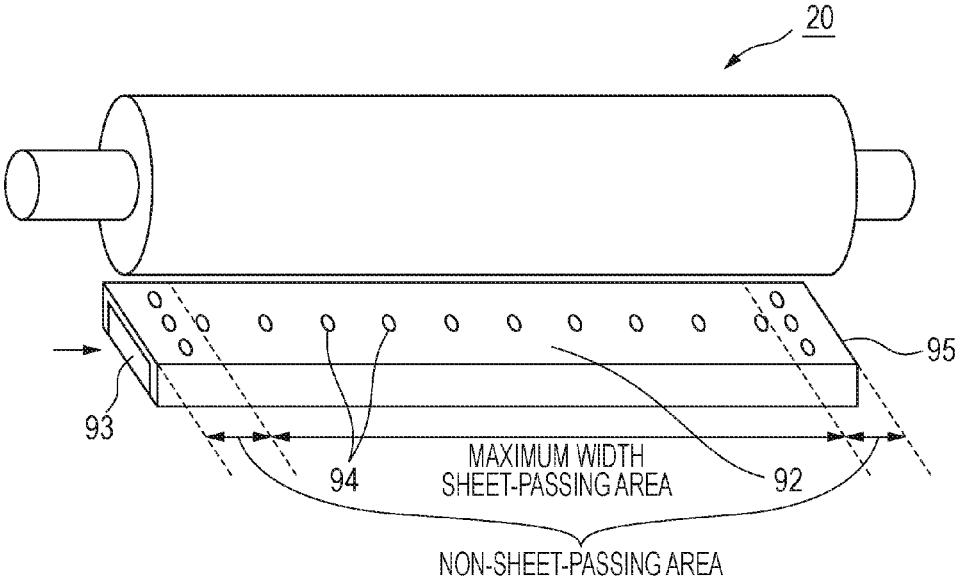
FIGS. 11A and 11B are views illustrating the second blower and pressurizing roller according to a fourth embodiment.
Figure 11B:
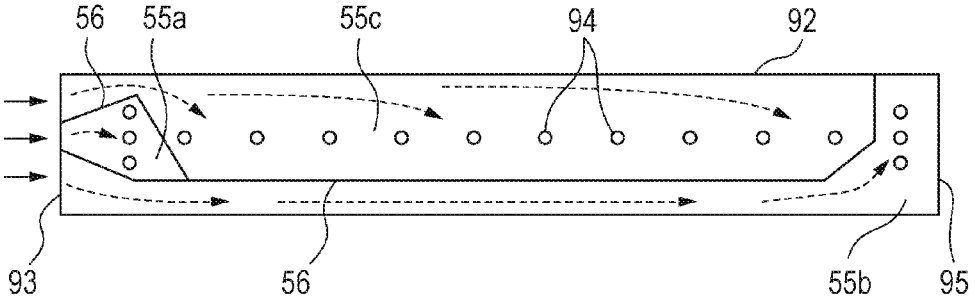

The duct 99 according to the present embodiment is configured so that the air volume to the passing area of a sheet having a maximum width that is passable is smaller than the air volume to the non-sheet-passing area, as an air volume distribution in the axis direction of the pressurizing roller 20 by the second fan 91. The specific configuration is illustrated in FIG. 11A. The number of holes 52 per unit length of the duct in the generatrix direction of the pressurizing roller 20 provided in the area α of the duct 99 is less than the number of holes 52 provided in the area β. Further, as illustrated in FIG. 11B, the duct is configured so that, by providing a partition 56 to the duct inner portion 55, the air volume can be distributed as described above without relying on distance from the fan 90 to each of the holes 94. That is to say, the second blower according to the present embodiment blows air so that the air volume toward the center portion of the pressurizing roller 20 is greater than the air volume blown toward the end portions in the direction orthogonal to the recording medium conveyance direction.

Next, control of the second blower (second fan 91) according to the present embodiment will be described. A condition in which slipping due to condensation readily occurs is, as described above, a case where the environment has high humidity and the temperature of the pressurizing roller 20 is comparatively low. Therefore, determination is made as to whether or not to drive the fan 90, depending on the degree of warming of the pressurizing roller 20 and the environment in which the image forming apparatus 1 illustrated in FIG. 10 is installed. According to the present embodiment, an environmental sensor 318 is used as the environmental detection member that detects the environment in which the image forming apparatus 1 is installed, detection temperature of the thermistor TH1 disposed on the back face side of the heater 31 is used as a member to detect the degree of warming of the pressurizing roller 20, and the number of printing sheets is used. The reason for using the detection temperature of the thermistor 35 is that the heater 31 forms a nip portion N with the pressurizing roller 20 via the fixing film 10, whereby the temperature of the pressurizing roller 20 can be measured if prior to controlling the heater 31.

Figure 12:
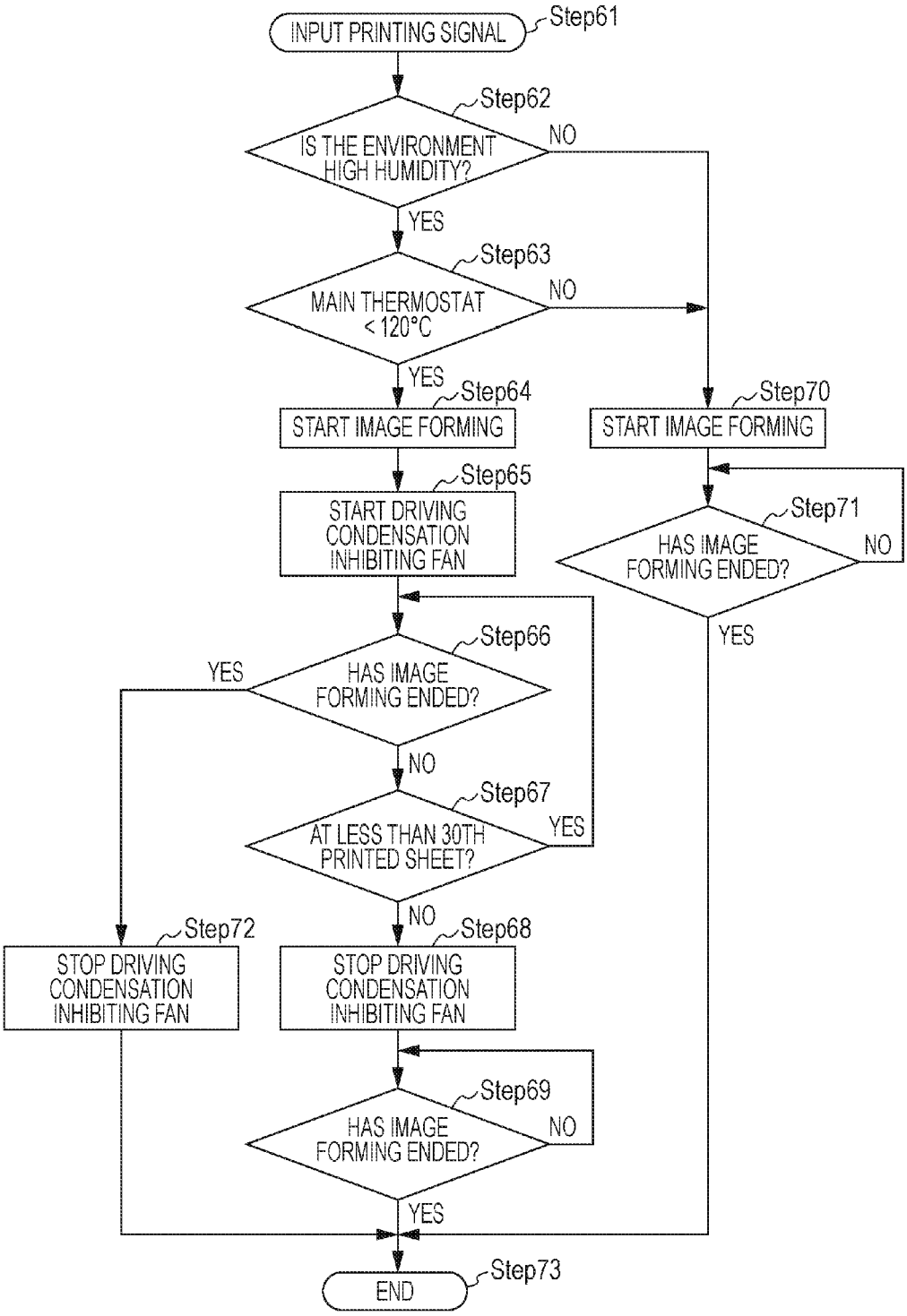
FIG. 12 is a flowchart illustrating control of the second blower when in condensation slipping prevention mode, according to the fourth embodiment.

Now, the control of the second fan 91 in an image-forming period will be described with reference to the flowchart in FIG. 12. First, when receiving the printing signal (Step 61), the environmental sensor 78 detects a high humidity environment (Step 62), and determines whether or not the detection temperature of the thermistor 35 at the time of printing starting (when starting the warm-up of the fixing device 70) is less than 120° C. (Step 63). In the case that the two above-mentioned conditions have been met, upon starting to form an image (Step 64), driving of the fan 79 is started at the timing when the first printed sheet reaches the nip portion N (Step 65). Subsequently, in the case that the image forming is ended within 30 sheets from the start of printing, the fan 79 is stopped at the same time as the end of the image forming (Step 72), and the process is ended (Step 73). In the case of continuing to print 30 sheets or more, the fan 79 is operated until the 30th sheet, and driving is stopped at the point in time when the 30th sheet has passed the nip portion N (Step 68). From the thirty-first sheet until the image forming is ended, the driving of the fan 79 is stopped.

Note that the environment sensor 78 detecting a high humidity environment in step 62 indicates a case wherein the humidity detected by the environment sensor 78 is greater than a predetermined value.

Now, it has been confirmed that in the case that the detection temperature of the thermistor 35 at the time of printing starting is 120° C. or greater, until the printing is ended, the temperature of the pressurizing roller 20 will not be such that condensation will form under any conditions. This is because the temperature of the pressurizing roller 20 during continuous printing has a tendency to be low at printing initialization and increase as the number of continuously printed sheets increase. Also, according to the fixing device 70 of the present embodiment, the number of sheets in which the pressurizing roller 20 reaches a temperature at which condensation does not form, while continuing to print continuously, regardless of the initial temperature of the pressurizing roller 20, is 30 sheets. Accordingly, even if the fan 79 is driven at printing initialization, the driving of the fan 79 is stopped at the thirty-first continuous sheet and thereafter. According to the present embodiment, when the temperature at the back of the heater 31 as detected by the thermistor 35 is lower than 120° C., an estimation is made that the temperature of the pressurizing roller 20 is at a temperature at which condensation forms, which is lower than a threshold temperature at which condensation does not form. Conversely, when the temperature at the back of the heater 31 as detected by the thermistor 35 is 120° C. or greater, the pressurizing roller 20 is estimated to be at or greater than the threshold temperature at which condensation does not form, so the pressurizing roller 20 is estimated to be at a temperature at which condensation does not form.

As described above, according to the present embodiment, by using both the detection temperature of the thermistor 35 at the time of printing starting and the number of printed sheets, estimation can be made as to whether the temperature of the pressurizing roller 20 is a temperature at which condensation will form, and the driving of the fan 79 is controlled.

Also, as another way to determine the degree of warming of the pressurizing roller 20, the pressurizing roller surface temperature may be directly detected by a temperature detecting member such as a thermopile. In this case, driving the fan 79 only in the case wherein the pressurizing roller surface temperature while passing sheets is lower than the predetermined threshold temperature, is an option. Also, the fixing count estimate described in the first embodiment may be used. As long as the temperature of the pressurizing roller 20 can be thus estimated, the method thereof is not to be limited to the above-described methods.

Next, as a performance evaluation of the present embodiment, the existence of image defect by slipping due to condensation and fixability are confirmed in a high temperature, high humidity environment (32.5° C./80%), and compared to two configurations that are conventional art described below. The sheet used for evaluation is an A4 size sheet (60 g/mm$^2$) that has been exposed to the above-described environment for a long period of time, the printing pattern is a solid black image, and 50 sheets are continuously printed from the state in which the fixing device is the same temperature as the room temperature. Also, the image forming apparatus used is enabled for A4 size paper with a print speed of 52 sheets per minute and FPOT 7.0 seconds. Also, the present embodiment and comparative example both reviews with the same heater control.

According to the present embodiment, the total air volume from the second fan 91 is 0.007 [$m^3$/min], and holes are disposed so as to divide the total air volume into three parts, with the sheet-passing area (210 mm) and non-sheet-passing area on both ends (20 mm each).

The third comparative example only differs in the disposal of the holes in the duct, and other configurations and fan control is the same. The duct in the fourth embodiment illustrated in FIG. 13 has holes disposed so that the total air volume 0.007 [$m^3$/min] from the fan is uniform over the entire pressurizing roller axis direction. Also, the fourth comparative example has a configuration that uses the duct in the third comparative example, has the fan attached in the reverse direction, and discharges the air near the pressurizing roller to the outside via the duct.

The evaluation results of the fourth embodiment, third comparative example, and fourth comparative example are indicated in Table 3. As evaluation items, image defect from slipping due to condensation and image defect from poor fixability are evaluated. The circles indicate there was no image defect, and the crosses indicate that an image defect has occurred.

TABLE 3

| | Image Defect from Slipping due to Condensation | Image Defect from Fixing Failure |
|---|---|---|
| Fourth Embodiment | ○ | ○ |
| Third Comparative Example | ○ | X |
| Fourth Comparative Example | X | ○ |

According to the third comparative example, there was no image defect from slipping due to condensation. This is because steam is suppressed from condensing over the entire pressurizing roller by blowing air approximately uniformly over the entire axis direction of the pressurizing roller from the duct. However, air is blown uniformly over the entire axis direction of the pressurizing roller so as to cool, whereby image defects occurred from fixability problems such as a portion of the solid black image being left white or transferring to the back of the following sheet, in the first fifteen sheets when the pressurizing roller temperature is relatively low. Thereafter, since the pressurizing roller warmed up, fixability improved. In order to improve the fixability defect, the target temperature of the heater has to be increased, whereby energy efficiency becomes poor.

According to the fourth comparative example, there was no image defect from deterioration in fixability in all fifty sheets, since air is only sucked from the pressurizing roller vicinity, and air is not blown over the entire axis direction area of the pressurizing roller. However, image defects from slipping due to condensation occurred in eight out of the fifty printed sheets. This indicates that, comparing the results of the comparative example 4 to the comparative example 3, this indicates that the cooling effects on the pressurizing roller 20 are greater when blowing air on the pressurizing roller 20 rather than discharging air from the vicinity of the pressurizing roller to the outside via a duct.

There was no image defect in the first embodiment. This is because the air volume to the sheet-passing area which has great influence on fixability and little influence on slipping due to condensation was lessened, and the air volume to the non-sheet-passing area which has little influence on fixability and great influence on slipping due to condensation was increased.

Thus, according to the present embodiment, slipping due to condensation can be suppressed without greatly reducing the surface temperature of the pressurizing roller. Further, according to the present embodiment, slipping due to condensation suppression effects can be greater than the third embodiment by blowing air as to the sheet-passing area in a lesser air volume than in the non-sheet-passing area.

Note that the present embodiment has been described as a device serving as the fixing device 70, having a cylindrical fixing film, a heater that touches the inner face of the fixing film, and a pressurizing roller that forms a nip portion together with the heater via the fixing film. However, the fixing device 70 is not limited to this. For example, the device may have a cylindrical fixing film, a heater that is contained inside the fixing film and heats the inner face of the fixing film with radiation heat, a nip portion forming member that touches the inner face of the fixing film, and a pressurizing roller that forms the nip portion via the fixing film together with the nip portion forming member. Also, the device may have a self-heating cylindrical belt, a nip portion forming member that touches the inner face of the cylindrical belt, and a pressurizing roller that forms the nip portion via the belt together with the nip portion forming member. Further, the device may have a fixing roller, a heater to heat the fixing roller, a cylindrical belt, and a nip portion forming member that touches the inner face of the cylindrical belt and forms the nip portion via the belt together with the fixing roller.

The sheet-passing area and non-sheet-passing area having different air volumes in the second blower of the present embodiment have a standard maximum width sheet (recording medium) that is conveyable with the nip N of the fixing device 70, but are not limited to this. The air volume may be differentiated by the sheet-passing area and non-sheet-passing area of a recording medium having a size other than the maximum width needing suppression of slipping due to condensation.

According to the present embodiment, an arrangement has been described in which the center in the width direction of the recording medium is matched to the center in the direction orthogonal to the recording medium conveyance direction of the nip of the fixing device, for conveying, but the embodiment is not limited to this. One or the other of the end portions in the width direction of the recording medium may be matched to an end portion in the direction orthogonal to the recording medium conveyance direction of the nip portion of the fixing device, for conveying. Further, according to the present embodiment, different air volumes are provided for the sheet-passing area and non-sheet passing area of the pressurizing roller 20 by the number of holes 52 in the duct 99, but different air volumes may be provided according to the size of the holes, or the like.

Also, the openings 93 of the duct 99 are provided to the end portions in the axis direction of the pressurizing roller 20 of the duct 99, but may be provided in the center portion of the duct 99.

According to the present embodiment, the second fan 91 is driven so that air is blown in the direction toward the pressurizing roller 20, but conversely, driving the second fan 91 to suck out the air near the pressurizing roller and discharge to the outside may be considered. However, a configuration wherein the air near the pressurizing roller 20 is sucked out is less effective against condensation than the configuration that blows the air on the pressurizing roller 20.

The reason for this will be explained. In the case of blowing air onto the pressurizing roller 20 as in the present embodiment, a predetermined area on the surface of the pressurizing roller 20 can be targeted to be blown on from the duct 50, whereby steam can be effectively dispersed to the portions in which condensation is to be suppressed. However, in the case of sucking out the air near the pressurizing roller 20 and discharging to the outside, the air in all directions is sucked from the holes 52 of the duct, so targeting air near a predetermined area on the surface of the pressurizing roller 20 is difficult, and this results in steam from a wide range being sucked out.

Also, according to the present embodiment, using the second blower 90 to control slipping due to condensation suppression is described, but the second blower 90 can be used both to suppress the non-sheet-passing portion temperature increases in the first embodiment and to suppress slipping due to condensation. Also, control may also be performed to suppress the temperature increasing on the non-sheet-passing area of the film 11 of the first blower 80, similar to the first embodiment.

Fifth Embodiment

Figure 13:
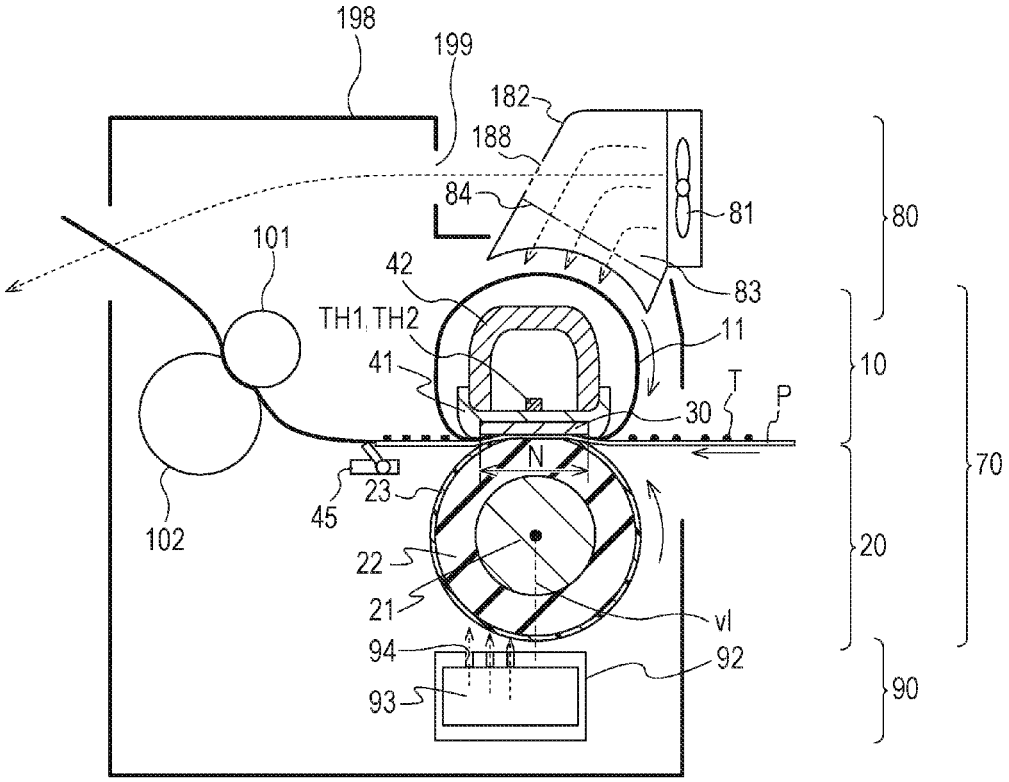
FIG. 13 is a cross-sectional diagram of a fixing device and blower according to a fifth embodiment.

A cross-sectional view of a fixing device according to the present embodiment is illustrated in FIG. 13. Differences between this and the fixing device in the first embodiment are that the fixing device has a conveyance roller pair (101, 102), and the first blower 80 can also blow on the upper portion of the conveyance roller pair (101, 102) and not only the non-sheet-passing area of the film 11. The portions other than those described below have the same configuration as the first embodiment, so the description thereof will be omitted.

A conveyance roller pair (101, 102) has a curl reforming roller 102 and a curl reforming facing roller 101 that forms a conveyance nip portion together with the curl reforming roller 102. The curl reforming facing roller 101 is a metal roller. The curl reforming roller 102 has an outer diameter that is greater than that of the curl reforming facing roller 101, and is an elastic roller formed with a silicon material to form the conveyance nip portion along the outer peripheral face of the curl reforming facing roller 101. Even in a case where the recording medium P curls after the fixing processing with the fixing nip portion N, the recording medium P is conveyed with the conveyance nip portion (101, 102), whereby the curling of the recording medium is corrected.

As illustrated in FIG. 13, a duct 182 has an opening 83 (first opening) that faces the film unit 10 and an opening 188 (second opening). A cover 198 has an opening 199 to taking the air into the cover 198 (inner portion of the fixing unit) at a position facing the opening 188 of the duct 182. The air surrounding the curl reforming facing roller 101 is discharged to the outside of the fixing device by the air from the first fan 81 that passes through the opening 188 and opening 199.

Configuration of First Blower

Figure 14A:
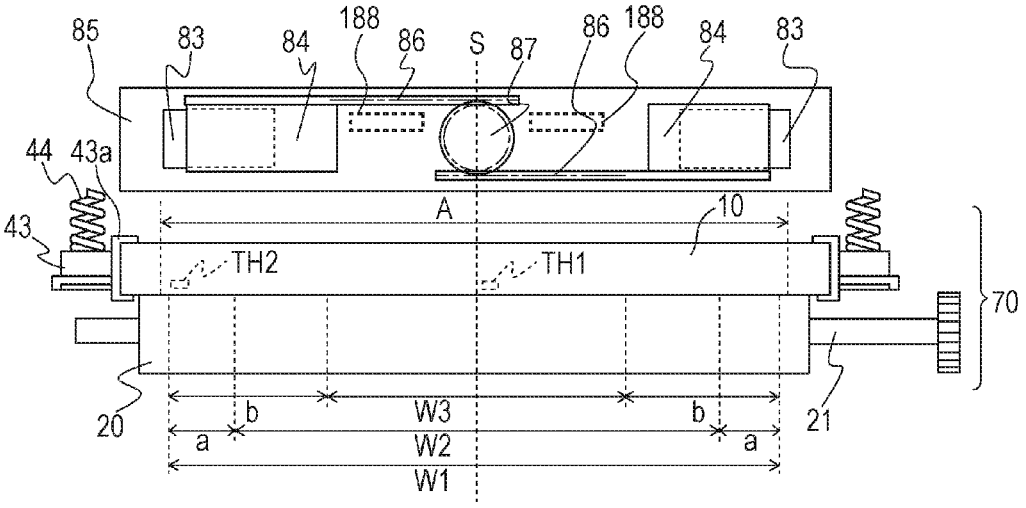
FIG. 14A is a diagram of the fixing device, as seen from the recording medium feeding side, according to the fifth embodiment.
Figure 14B:
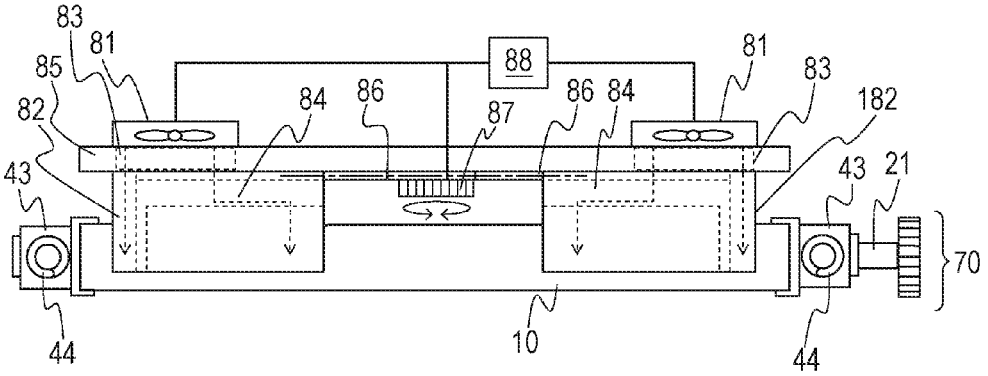
FIG. 14B is a diagram of a first blower, as seen from above, according to the fifth embodiment.

FIG. 14A is a diagram of the main parts of a fixing device according to the present embodiment as seen from the recording medium feeding side, and FIG. 14B is a diagram of the main parts of a fixing device according to the present embodiment as seen from above. The opening and closing mechanism of the shutter 84 is the same as the first embodiment so the description thereof will be omitted. The position of the opening 83 that is in the direction orthogonal to the recording medium conveyance direction is a position that faces the end portion of the film 11 and also is a position that faces the first fan 81. On the other hand, the position of the opening 188 is a position near the center portion of the film 11, and is not in a position that faces the first fan 81. The position of the opening 188 is a position that is not closed off by the shutter 84, even if the shutter 84 is moved to a position nearest to the center portion of the film 11. Accordingly, when the first fan 81 is driven, air is constantly blown above the curl reforming facing roller 101 via the opening 188. Also, when the shutter 84 is open, the air blown from the first fan 81 can more easily blow through the opening 83 than the opening 188.

The air from the first fan 81 via the opening 188 blows above the curl reforming facing roller 101, and does not directly hit the film 11, so the film 11 is not excessively cooled.

Control of Blower

A control method for the first blower 80 and second blower 90 according to the present embodiment is described in Table 4. The first blower 80 and second blower 90 according to the present embodiment controls the opening amount of the shutter 84 and the air volume of the first fan 81 and second fan 91 according to the sheet size, environment, heat storage in the fixing device, and temperature at the non-sheet-passing area. The information of the sheet size, environment, heat storage in the fixing device, and temperature at the non-sheet-passing area can be obtained from the sheet width sensor, environmental sensor, fixing count estimate, and thermistor TH2, respectively. Note that control of the second blower 90 (second fan 81) is the same as the third and fourth embodiments, so the description thereof will be omitted.

TABLE 4

| | | Condition to Start Operation of First Fan 81 and Second Fan 91 | | | |
|---|---|---|---|---|---|
| Operation target | Operation Purpose | Fixing Count | Temperature Sensor TH2 | Supply Power to First Blower | Main Unit Installation Environment Humidity |
| First fan 81 | Inhibit condensation on decal facing roller 101 | — | — | — | — |
| | Suppress temperature increase in non-sheet-passing area of fixing film | — | Predetermined value or greater | Adjust occasionally so that TH2 is contained in a desired range | — |

TABLE 4-continued

| | | Condition to Start Operation of First Fan 81 and Second Fan 91 | | | |
|---|---|---|---|---|---|
| Operation target | Operation Purpose | Fixing Count | Temperature Sensor TH2 | Supply Power to First Blower | Main Unit Installation Environment Humidity |
| Second fan 91 | Suppress temperature increase in non-sheet-passing area of pressurizing roller | — | — | 60% or greater | — |
| | Inhibit slipping due to condensation | Less than 1,001 | — | — | 80% or greater |

Control of First Blower

Figure 15:
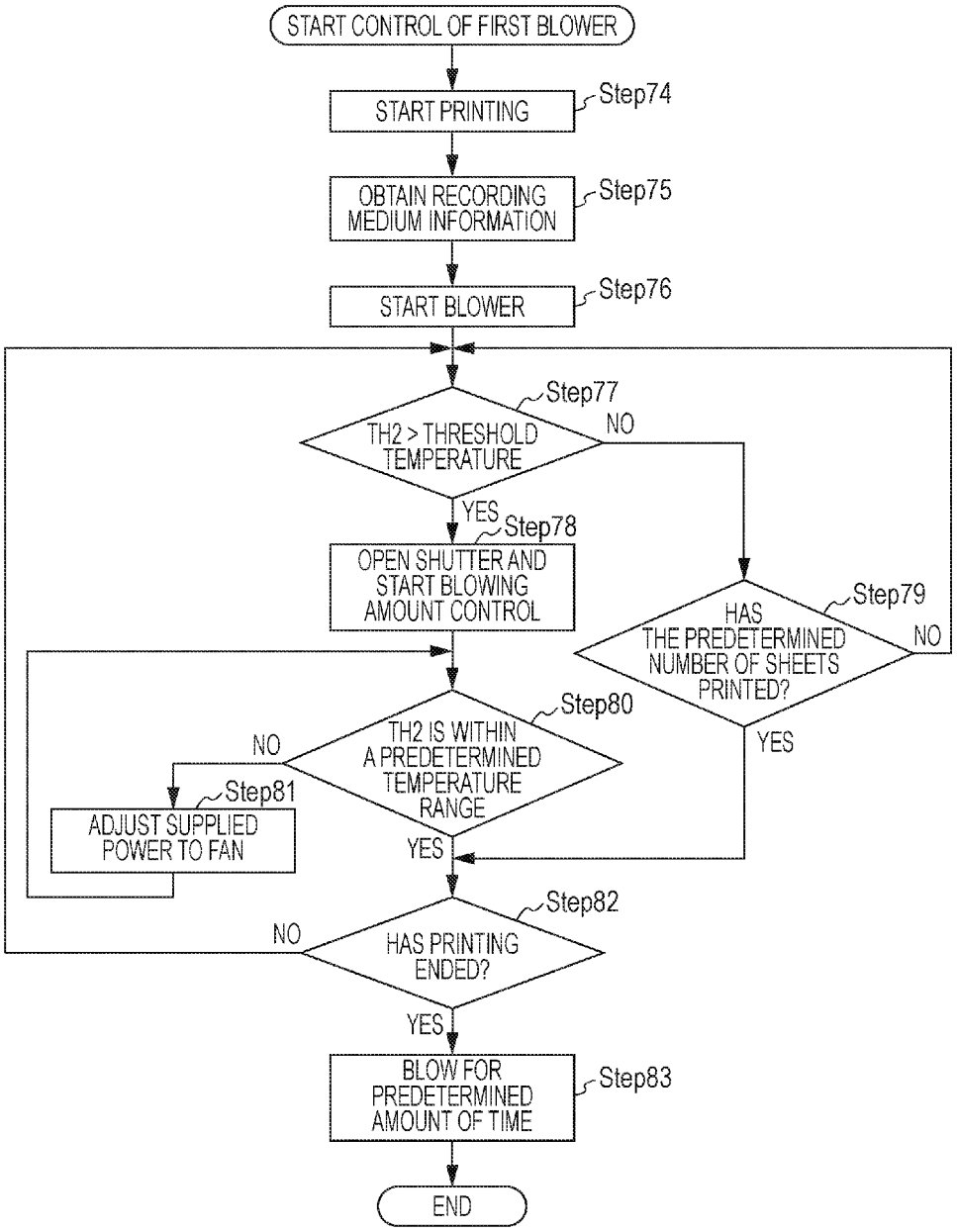
FIG. 15 is a flowchart illustrating control of the first blower according to the fifth embodiment.
Figure 16A:
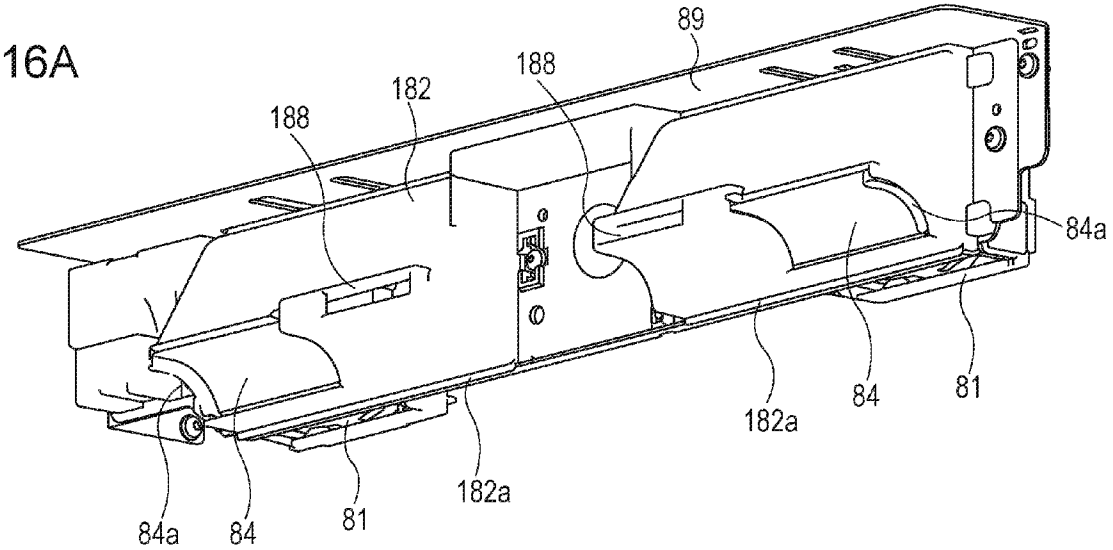
FIGS. 16A and 16B are views of the first blower according to the fifth embodiment.
Figure 16B:
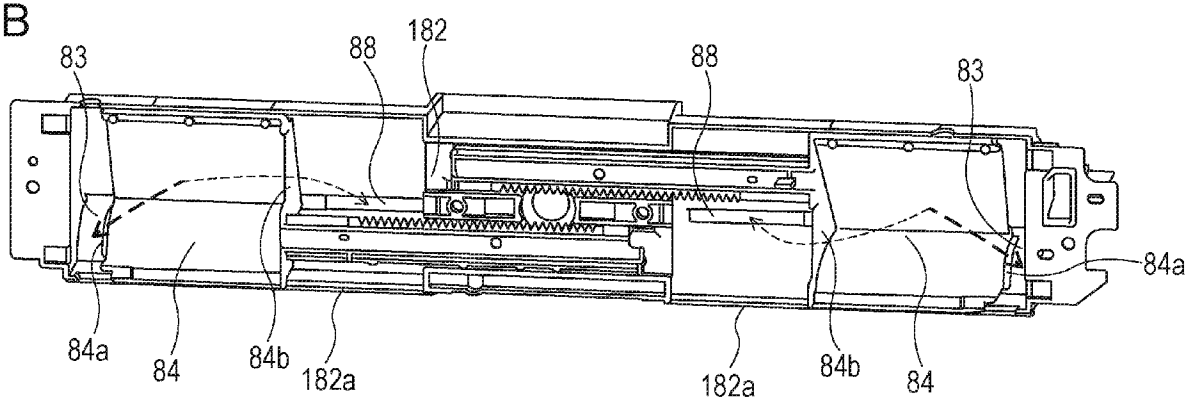

According to the present embodiment, the first blower 80 has the two roles of suppressing the temperature increasing on the non-sheet-passing area of the film 11 and the condensation inhibiting of the curl reforming facing roller 101. Control of the first blower 80 according to the present embodiment will be described with reference to the flowchart in FIG. 15.

First, a printing operation is started by a printing signal according to the image information input from an external host device 200 (Step 74). Subsequently, the control circuit 100 obtains information about the recording member size that a user has input, and information relating to the recording medium width W which is to be sheet-passed, from information of the recording medium size detecting sensor such as the sheet supplying cassette or the like (Step 75). Power is supplied to the first fan 81 and blowing is started (Step 76). Immediately following the printing operation, the curl reforming facing roller 101 which is a metal roller has similar temperature as the room temperature, whereby the steam generated at the time of fixing processing readily forms condensation on the curl reforming facing roller 101. Now, the steam generated in the periphery of the curl reforming facing roller 101 is discharged to the outside of the fixing device in the present embodiment, inhibiting condensation from forming on the curl reforming facing roller 101. Note that at the point in time of Step 76, the opening amount of the opening 83 of the shutter 84 is a position of 0 mm (home position).

Next, the control circuit 100 monitors the detection temperature of the thermistor TH2 during printing operations, and determines whether or not there is a temperature increase in the non-sheet-passing area of the film 11 (Step 77).

When the detection temperature of the thermistor TH2 is at or above the threshold temperature, the control circuit 100 performs operation instructions for temperature increase suppression of the non-sheet-passing area as to the control unit 88, based on the size information of the recording medium. Specifically, the opening 83 moves the shutter so as to be open in the amount corresponding to the recording member size (Step 78). Supply power as to the first fan 81 is adjusted so that the detection temperature of the thermistor TH2 is contained within a predetermined temperature range (Steps 80 and 81).

For example, when in letter-size transverse feed, the supply power as to the first fan 81 is adjusted so that the detection temperature of the thermistor TH2 that determines the blowing start is 250° C., the opening amount of the opening 83 is 5.3 mm, and the thermistor TH2 is contained in the range of 250 to 260° C.

In the case that the printing processing has ended (Step 82), the shutter 84 is moved to the home position, the blowing of the first fan 81 is continued for a predetermined amount of time (Step 83), and subsequently the blowing is stopped. The steam in the periphery of the curl reforming facing roller 101 is discharged to the outside of the fixing device, and condensation is inhibited. According to the present embodiment, steam that collects above the curl reforming facing roller 101 is discharged.

Note that there are case of monitoring the thermistor TH2 (Step 77), printing a predetermined number of sheets in a state wherein the detection temperature of the thermistor TH2 is lower than the threshold temperature (Step 79), and the printing operations are ended (Step 82). In this case, the blowing of the first fan 81 is continued for a predetermined amount of time (Step 83) while the shutter 84 is in a state of being in the home position, after which the blowing of the first fan 81 is stopped.

Immediately following a so-called cold start, which is starting the printing while the fixing device is in a cool state, the temperature increasing on the non-sheet-passing area of the fixing device does not worsen, and is in a state wherein condensation readily forms on the curl reforming facing roller 101. At this time, the detection temperature of the thermistor TH2 is lower than the threshold temperature and the shutter 84 is in a state of the opening 83 being closed, whereby the air from the first fan 81 is used primarily to suppress condensation on the curl reforming facing roller 101.

On the other hand, when continuous printing is continued and the temperature increasing on the non-sheet-passing area continues to worsen, the detection temperature of the thermistor TH2 is higher than the threshold temperature and the shutter 84 is in a state of opening the opening 83, whereby a large portion of the air from the first fan 81 is used to cool the non-sheet-passing area of the film 11.

That is to say, the timing of the temperature increasing on the non-sheet-passing area in the fixing device and the condensation on the curl reforming facing roller 101 differ, so the first fan 81 can be used as to the two problems described above. The air volume in the opening 188 of the present embodiment is greater when the detection temperature of the thermistor TH2 is lower rather than higher than the threshold temperature, and is greater when the opening amount of the opening 83 by the shutter 84 is smaller rather than greater.

As described above, according to the fixing device of the present embodiment, suppressing the temperature increasing on the non-sheet-passing area, and inhibiting condensation from forming on the pressurizing roller and condensation from forming on the curl reforming facing roller, can be realized at the same time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus that forms a toner image on a recording medium, the image forming apparatus comprising:

an image forming unit configured to form the toner image on a recording medium;

a fixing unit configured to fix the toner image on the recording medium while conveying and heating the recording medium bearing the toner image at a fixing nip portion, the fixing unit including a heating member, and a pressurizing member forming the fixing nip portion with the heating member, a conveyance roller pair configured to convey the recording medium on which the toner image has been fixed at the fixing nip portion, and a cover covering the heating member and the conveyance roller pair;

a blower unit including a duct and a fan configured to blow air to a non-sheet-passing area of the heating member, the duct including a first opening through which airflow from the fan is directed to the non-sheet-passing area of the heating member and a second opening through which airflow from the fan discharges air surrounding the conveyance roller pair, wherein the cover includes a third opening, and airflow from the fan is directed through the second opening of the duct and the third opening of the cover to discharge air surrounding the conveyance roller pair.

2. The image forming apparatus according to claim 1, wherein the conveyance roller pair includes a metal roller and an elastic roller forming a conveyance nip portion with the metal roller.

3. The image forming apparatus according to claim 1, wherein the second opening is provided at a position closer to a center of the heating member than the first opening, in the longitudinal direction of the heating member.

4. The image forming apparatus according to claim 1, wherein the airflow through the second opening is not directed to the non-sheet-passing area of the heating member.

5. The image forming apparatus according to claim 1, further comprising:

a shutter configured to move to adjust an opening amount of the first opening.

6. The image forming apparatus according to claim 5, wherein the second opening is provided at a position that is not closed off by the movement of the shutter.

7. The image forming apparatus according to claim 5, wherein the smaller the opening amount of the first opening is, the larger an air volume of the airflow through the second opening is.

8. The image forming apparatus according to claim 1, wherein the second opening is configured not to face the heating member.

9. The image forming apparatus according to claim 1, wherein the second opening of the duct is configured not to overlap with the first opening of the duct in a longitudinal direction of the heating member.

* * * * *